US012734458B2

(12) United States Patent
Fazio et al.

(10) Patent No.: US 12,734,458 B2
(45) Date of Patent: Sep. 15, 2026

(54) STRING SHOOTING DEVICE

(71) Applicant: ZIPSTRING LLC, Johns Creek, GA (US)

(72) Inventors: Stephen Giovanni Fazio, Atlanta, GA (US); Austin Mark Hillam, Atlanta, GA (US)

(73) Assignee: ZIPSTRING LLC, Johns Creek, GA (US)

( * ) Notice: Subject to any disclaimer, the term of this patent is extended or adjusted under 35 U.S.C. 154(b) by 0 days.

(21) Appl. No.: 19/391,499

(22) Filed: Nov. 17, 2025

(65) Prior Publication Data

US 2026/0071843 A1 Mar. 12, 2026

Related U.S. Application Data

(63) Continuation of application No. 19/093,482, filed on Mar. 28, 2025, now Pat. No. 12,504,250, which is a continuation-in-part of application No. 19/075,598, filed on Mar. 10, 2025, now Pat. No. 12,422,211.

(60) Provisional application No. 63/692,214, filed on Sep. 9, 2024, provisional application No. 63/562,770, filed on Mar. 8, 2024.

(51) Int. Cl.

| | |
|---|---|
| ***A63H 33/00*** | (2006.01) |
| ***A63H 29/20*** | (2006.01) |
| ***A63H 33/22*** | (2006.01) |
| ***F41B 4/00*** | (2006.01) |

(52) U.S. Cl.

CPC ..... *A63H 33/00* (2013.01); *A63H 29/20* (2013.01); *A63H 33/22* (2013.01); *F41B 4/00* (2013.01)

(58) Field of Classification Search

CPC ..... F41B 4/00; A63H 29/20; A63H 29/22; A63H 29/24; A63H 33/00; A63H 33/22

USPC ..... 124/78, 81, 82; 446/26, 236, 266

See application file for complete search history.

(56) References Cited

U.S. PATENT DOCUMENTS

| | | | |
|---|---|---|---|
| 1,697,547 | A | 1/1929 | Streid |
| 1,724,271 | A | 8/1929 | Fisher |
| 1,724,708 | A | 8/1929 | Harris |
| 1,838,243 | A | 12/1931 | Wismer |

(Continued)

FOREIGN PATENT DOCUMENTS

| | | | | |
|---|---|---|---|---|
| CN | 113797561 A | * | 12/2021 | ..... A63H 33/22 |
| CN | 216092242 U | * | 3/2022 | |

(Continued)

OTHER PUBLICATIONS

Notice of Allowance and Fees Due (PTOL-85) Mailed on Feb. 15, 2024 for U.S. Appl. No. 18/309,086, 7 page (s).

(Continued)

*Primary Examiner* — Alexander R Niconovich

(74) *Attorney, Agent, or Firm* — Alston & Bird LLP

(57) ABSTRACT

A string shooting device, and more particularly, a string shooting device having that is wearable and operable by hand gestures or body movement is detailed herein. Embodiments include a wearable device for propelling a string including: a string shooting device; a band configured to attach to a body part of a user; and a holder, where the holder is secured by the band to the user; where, in response to the body part of the user being in a first position, the string shooting device is not actuated, and where in response to the body part of the user being in a second position, the string shooting device is actuated.

20 Claims, 33 Drawing Sheets

(56) References Cited

U.S. PATENT DOCUMENTS 1,877,559 A 9/1932 Copple
2,289,490 A 7/1942 Fisher
2,423,448 A * 7/1947 Haight ..... F41C 9/02 2/160
2,689,558 A 9/1954 Sealer et al.
2,692,593 A 10/1954 Flores, Jr.
2,825,322 A 3/1958 Burley et al.
2,848,834 A 8/1958 Cox
3,060,625 A 10/1962 Glass et al.
3,190,031 A * 6/1965 Tengelitsch ..... A63H 33/3072 472/64
3,202,378 A * 8/1965 Williamson ..... A63H 27/002 242/390.8
3,398,949 A 8/1968 Young
3,406,967 A 10/1968 Young
3,491,479 A * 1/1970 Carter ..... A63H 33/3072 446/145
3,693,609 A 9/1972 Vodinh
3,797,163 A * 3/1974 McRoskey ..... A63H 33/3072 446/145
3,902,722 A 9/1975 Skillern
3,904,098 A 9/1975 Kupperman et al.
4,045,026 A * 8/1977 Gillespie ..... A63B 60/50 473/465
4,077,386 A 3/1978 Berliner
4,266,369 A * 5/1981 Spector ..... A63H 21/02 472/7
4,436,077 A 3/1984 Smith
4,452,007 A * 6/1984 Martin ..... A63H 27/00 416/4
4,521,205 A 6/1985 Spector
4,552,365 A 11/1985 Smith
4,676,219 A 6/1987 Miller
4,768,681 A 9/1988 Dean et al.
4,781,647 A 11/1988 Doane, Jr.
4,840,598 A 6/1989 Schuetz
4,949,494 A 8/1990 Mims
D322,298 S 12/1991 Sternbach
5,072,856 A 12/1991 Kimble
5,205,266 A 4/1993 Kilby, Jr.
5,279,276 A 1/1994 Nagel et al.
5,375,848 A 12/1994 Coleman
5,471,967 A 12/1995 Matsuzaki et al.
5,471,968 A 12/1995 Lee
5,484,085 A * 1/1996 Bennett ..... F41H 9/10 222/530
5,611,321 A 3/1997 Hoeting et al.
5,657,738 A 8/1997 Klundt
5,671,539 A 9/1997 Barone
5,678,730 A * 10/1997 Fabek ..... A45F 5/00 222/402.15
5,692,489 A 12/1997 Swanson et al.
5,733,169 A 3/1998 Tsai
5,749,761 A 5/1998 Kim
5,791,965 A 8/1998 Kim
5,810,637 A 9/1998 Mileti
5,970,970 A 10/1999 Vanek et al.
6,286,495 B1 9/2001 Brown
6,520,825 B1 2/2003 Herr
6,523,535 B2 2/2003 Rehkemper et al.
6,537,126 B2 * 3/2003 Wagner ..... A63H 33/00 446/236
6,814,260 B2 * 11/2004 Caffrey ..... B05B 9/0811 446/475
6,915,793 B2 7/2005 Vanek et al.
6,955,581 B1 10/2005 Liu
7,476,166 B2 1/2009 Yearick
7,673,624 B2 3/2010 Rosella, Jr.
D640,759 S 6/2011 Mastin et al.
8,556,675 B2 10/2013 Gonzalez
8,876,574 B2 * 11/2014 Bourdelaise ..... A63H 37/00 446/475
8,939,332 B2 1/2015 Elliott
8,955,503 B2 2/2015 Corsiglia et al.
9,022,012 B2 5/2015 Loetz et al.
9,101,850 B2 * 8/2015 Gonzalez ..... A63H 27/10
10,850,207 B2 12/2020 Tilley
D949,714 S 4/2022 Tan
D977,594 S 2/2023 Chen
D990,586 S 6/2023 Hu
11,674,774 B2 * 6/2023 Fazio ..... F41B 4/00 124/78
D994,039 S 8/2023 Zhang
D994,790 S 8/2023 Yue
D1,000,573 S 10/2023 Shen
11,879,703 B2 1/2024 Fazio et al.
D1,013,797 S 2/2024 Chen
D1,017,726 S 3/2024 Liao
D1,018,714 S 3/2024 Chen
D1,019,815 S 3/2024 Chen
11,918,927 B1 * 3/2024 Fazio ..... A63H 29/24
12,025,399 B2 7/2024 Fazio et al.
D1,039,067 S 8/2024 Fazio et al.
12,053,711 B1 * 8/2024 Sadigursky ..... A63H 29/20
D1,046,013 S 10/2024 Fazio et al.
12,194,392 B1 1/2025 Sadigursky et al.
12,241,715 B2 3/2025 Fazio et al.
12,422,211 B1 * 9/2025 Fazio ..... A63H 33/22
12,504,250 B2 * 12/2025 Fazio ..... A63H 33/00
2003/0040248 A1 2/2003 Wagner
2004/0082263 A1 4/2004 Parrish
2004/0134114 A1 7/2004 Afshari
2004/0155058 A1 8/2004 Dunham et al.
2006/0164856 A1 7/2006 Wang
2006/0170157 A1 8/2006 Weingard et al.
2013/0014735 A1 1/2013 Mowbray
2013/0104870 A1 * 5/2013 Rizzo ..... A63B 69/38 124/78
2013/0217300 A1 8/2013 Skifstrom et al.
2015/0079868 A1 3/2015 Stites
2015/0184844 A1 7/2015 Zhang
2016/0074759 A1 * 3/2016 Kelly ..... A63H 1/24 446/242
2019/0298010 A1 * 10/2019 Hacsi ..... A63H 29/24
2021/0354012 A1 11/2021 Arnold
2022/0111203 A1 4/2022 Doskocil et al.
2023/0152054 A1 5/2023 Fazio et al.
2024/0181366 A1 6/2024 Fazio et al.

FOREIGN PATENT DOCUMENTS

CN 216319961 U 4/2022
CN 219023242 U 5/2023
EM 009141872-0002 11/2022
WO 01/23060 A1 4/2001
WO 2024/073749 A1 4/2024

OTHER PUBLICATIONS

Notice of Allowance and Fees Due (PTOL-85) Mailed on Nov. 26, 2024 for U.S. Appl. No. 18/441,513, 7 page (s).
Notice of Allowance and Fees Due (PTOL-85) Mailed on Oct. 30, 2024 for U.S. Appl. No. 18/663,942, 8 page (s).
Notice of Allowance and Fees Due (PTOL-85) Mailed on Oct. 31, 2023 for U.S. Appl. No. 18/454,352, 8 page (s).
Notice of Allowance and Fees Due (PTOL-85) Mailed on Sep. 15, 2025 for U.S. Appl. No. 19/093,482, 8 page (s).
Office Action Appendix Mailed on Apr. 15, 2024 for U.S. Appl. No. 29/914,744, 21 page(s).
Office Action Appendix Mailed on Sep. 15, 2025 for U.S. Appl. No. 19/093,482, 4 page(s).
Outgoing—ISA/210—International Search Report Mailed on Jan. 8, 2024 for WO Application No. PCT/US23/075218, 4 page(s).
Petition for Inter Partes Review of U.S. Pat. No. 11,674,774, *Nxtgen Toys, LLC* v. *Zipstring, LLC,* IPR2024-01213, (Jul. 25, 2024).
Requirement for Restriction/Election Mailed on Dec. 7, 2023 for U.S. Appl. No. 29/849,110, 5 page(s).
Requirement for Restriction/Election Mailed on Dec. 7, 2023 for U.S. Appl. No. 29/914,744, 5 page(s).
Requirement for Restriction/Election Mailed on Jun. 28, 2024 for U.S. Appl. No. 18/441,513, 8 page(s).

(56) References Cited

OTHER PUBLICATIONS

RulofMaker, Musical String Shooter—uncontainable Loop! Diy, https://www.youtube.com/watch?v=D7TMIMZI3Lo.
Scorch Works, String Shooter, https://www.youtube.com/watch?v=IGIDy-IJxmo, (Jul. 4, 2018).
Sharma, Sunita et al., "Yarn Hairiness Determination Using Image Processing," IOSR Journal of Electronics and Communication Engineering, 11(Issue 5), Ver. II:48-52, (Sep.-Oct. 2016).
Tachionics, Giant 80 ft Rope—String Shooter, https:www.youtube.co/watch?v=Heyvw-SvVeA.
Translation CN113797561A (Year: 2021).
Translation CN216092242 U (Year: 2022).
TTPM Toy Reviews, Marvel Ultimate Spider-Man Motorized String Web Shooter from Hasbro, https://m.youtube.com/watch?v=hforOw9mJCU.
Tyagi, G.K., "Yarn structure and properties from different spinning techniques," Chapter 5 of Advances in Yarn Spinning Technology, pp. 119-154, published by Woodhead Publishing Limited, (2010).
www.ScienceBob.com, Build Your Own String Thing https:sciencebob.com-content/upload/2018/11/Build-a-String-Thing.pdf.
Yeany, Bruce, "String shooter-String launcher-physics of toys //// Homemade Science with Bruce Yeany," YouTube, (Jun. 11, 2014). [Retrieved from the Internet Nov. 14, 2023: <URL: https://www.youtube.com/watch?v=rffAjZPmkuU>].
YouTube video, String Shooter , https://www.youtube.com/watch?v=IGIDy-ljxmo.
Final Rejection Mailed on Jan. 14, 2026 for U.S. Appl. No. 18/441,513, 9 page(s).
"Loop Lasso Rope Launcher Toy", available 2023. [online], [site visited Nov. 22, 2023]. Retrieved from Internet, URL: https://www.gearelevation.com/products/loop-lasso-rope-launcher-toy (Year: 2023).
"String Shooter-String Launcher-Physics of Toys. Homemade Science," available Jun. 11, 2014, [online], [site visited Nov. 30, 2023]. Retrieved from Internet, URL: https://www.youtube.com/watch?v=rffAjZPmkuU> (Year: 2014).
"String Thing—Physics Toy," available Jun. 30, 2017, [online], [site visited Nov. 30, 23]. Retrieved from Internet, URL: http://www.youtube.com/watch?v=Wd_K6HIktVc&t=23s> (Year: 2017).
"Zip String—Can you push a string?" available online Sep. 7, 2021, [online], [site visited Nov. 22, 2023]. Retrieved from Internet, URL: https://www.youtube.com/watch?v=BRd1Kx5Ks7M (Year: 2021).
"Zip String" Store, available 2023, [online], [site visited Nov. 22, 2023]. Retrieved from Internet, URL: https://www.amazon.com/stores/ZIPSTRINGLLC/Homepage/page/44C11F34-6714-4CCB-AFDD-90238E1113FA (Year: 2023).
"Zip String", available Feb. 5, 2023, [online], [site visited Nov. 22, 2023]. Retrieved from Internet, URL: https://www.amazon.com/ZipString-Experience-Tank-Featured-Illuminating-Propeller/dp/BOBS?4YCX7/ref=cm_cr_arp d_product_top?ie=UTF8&th=1 (Year: 2023).
Abello, Margaux et al., "String Shooter's overall shape in ambient air," Emergent Scientist, vol. 4 (2020) (8 pages) https://www.researchgate.net/figure.net/Illustration-of the-solutions-z-and-parameters-x-The-axes-is-at-O fig6338578099.
C.C.L. Gregory, Theory of a loop revolving in air, with observations on the skin-friction, Q. J. Mech. Appl. Math. 2, (1949).
D"Art of Science, Science Behind our String Shooter Video, YouTube https://www.youtube.com/watch?v=7Lz0DfLUIzQ.
Daerr, Adrian et al., "The Charmed String: Self-Supporting Loops Through Air Drag," Journal of Fluid Mechanics, 877:1-12, (Aug. 20, 2019).
Decision Granting Institution of Inter Partes Review, Petition for Inter Partes Review of U.S. Pat. No. 11,674,774 B2, *Nxtgen Toys, LLC* v. *Zipstring, LLC*, IPR2024-01213, (Feb. 24, 2025).
Examiner Interview Summary Record (PTOL-413) Mailed on Aug. 15, 2025 for U.S. Appl. No. 19/075,598, 1 page(s).
Examiner Interview Summary Record (PTOL-413) Mailed on Jan. 17, 2024 for U.S. Appl. No. 29/914,744, 2 page(s).
Examiner Interview Summary Record (PTOL-413) Mailed on May 22, 2025 for U.S. Appl. No. 19/075,598, 2 page(s).
Examiner Interview Summary Record (PTOL-413) Mailed on Oct. 30, 2024 for U.S. Appl. No. 18/663,942, 1 page(s).
Examiner Interview Summary Record (PTOL-413) Mailed on Sep. 15, 2025 for U.S. Appl. No. 19/093,482, 1 page(s).
IPEA/408—Written Opinion of the IPEA Mailed on Jan. 8, 2024 for WO Application No. PCT/US23/075218, 8 page(s).
IPEA/409—International Preliminary Report on Patentability Mailed on Apr. 10, 2025 for WO Application No. PCT/US23/075218, 10 page(s).
ISA/220—Notification of Transmittal or Search Report and Written Opinion of the ISA, or the Declaration Mailed on Jun. 20, 2025 for WO Application No. PCT/US25/019243, 14 page(s).
JBK Ideas, DIY—How to make free energy water pump, https:www.youtube.com/watch?v7Lz0DfLUlzQ.
KiwiCO, Glow String Shooter, https://www.kiwico.com/us/store/dp/glow-string-shooter-project-kit/3823? (6 pages).
KiwiCO, Inc., Glow String Shooter, Instruction Manual, 17 pgs., (2021).
KiwiCO, String Guide Kit—Add On, 1pg.
Kul, Taras, "String Thing—Physics Toy," YouTube, (Jun. 30, 2017). [Retrieved from the Internet Jun. 30, 2017: <URL: https://www.youtube.com/watch?v=Wd_K6HlktVc&t=23s>].
Kul, Taras, "String Thing—Physics Toy," YouTube, Jun. 30, 2017, [Retrieved from the Internet Nov. 14, 2022], URL: <https://www.youtube.com/watch?v=Wd_K6HlktVc&t=23s>.
List of references cited by examiner Mailed on Apr. 7, 2023 for U.S. Appl. No. 18/056,567, 4 page(s).
List of references cited by examiner Mailed on Apr. 15, 2024 for U.S. Appl. No. 29/914,744, 2 page(s).
List of references cited by examiner Mailed on Aug. 5, 2024 for U.S. Appl. No. 29/849,110, 1 page(s).
List of references cited by examiner Mailed on Dec. 7, 2023 for U.S. Appl. No. 29/914,744, 2 page(s).
List of references cited by examiner Mailed on Feb. 15, 2023 for U.S. Appl. No. 18/056,567, 2 page(s).
List of references cited by examiner Mailed on Feb. 15, 2024 for U.S. Appl. No. 18/309,086, 4 page(s).
List of references cited by examiner Mailed on Nov. 3, 2023 for U.S. Appl. No. 18/309,086, 4 page(s).
Loop Lasso, "Loop Lasso Unboxing Video," YouTube, Apr. 14, 2022, [Retrieved from the Internet Nov. 14, 2022], URL: <https://www.youtube.com/watch?v=sgbHmg1nK6U>.
Loop Lasso, "Physics Meets Fun For All Ages," 2022, [Retrieved from the Internet Sep. 1, 2022], URL :<https://looplasso.com/>.
Mould, Steve, "This String Shooter Is So Weird," YouTube video https://www.youtube.com/watch?v=pV3zyy6OryE&L=4s.
Non-Final Rejection Mailed on Apr. 15, 2024 for U.S. Appl. No. 29/849,110, 6 page(s).
Non-Final Rejection Mailed on Aug. 26, 2024 for U.S. Appl. No. 18/441,513, 6 page(s).
Non-Final Rejection Mailed on Feb. 15, 2023 for U.S. Appl. No. 18/056,567, 13 page(s).
Non-Final Rejection Mailed on Jan. 2, 2024 for U.S. Appl. No. 29/914,744, 6 page(s).
Non-Final Rejection Mailed on Jul. 12, 2024 for U.S. Appl. No. 18/663,942, 13 page(s).
Non-Final Rejection Mailed on Jun. 10, 2025 for U.S. Appl. No. 18/441,513, 8 page(s).
Non-Final Rejection Mailed on May 2, 2025 for U.S. Appl. No. 19/075,598, 12 page(s).
Non-Final Rejection Mailed on May 12, 2025 for U.S. Appl. No. 19/093,482, 14 page(s).
Non-Final Rejection Mailed on Nov. 3, 2023 for U.S. Appl. No. 18/309,086, 11 page(s).
Non-Final Rejection Mailed on Sep. 27, 2023 for U.S. Appl. No. 18/354,014, 14 page(s).
Notice of Allowance and Fees Due (PTOL-85) Mailed on Apr. 7, 2023 for U.S. Appl. No. 18/056,567, 7 page (s).
Notice of Allowance and Fees Due (PTOL-85) Mailed on Apr. 15, 2024 for U.S. Appl. No. 29/914,744, 7 page (s).
Notice of Allowance and Fees Due (PTOL-85) Mailed on Aug. 5, 2024 for U.S. Appl. No. 29/849,110, 7 page (s).

(56) References Cited

OTHER PUBLICATIONS

Notice of Allowance and Fees Due (PTOL-85) Mailed on Aug. 15, 2025 for U.S. Appl. No. 19/075,598, 8 page (s).
Notice of Allowance and Fees Due (PTOL-85) Mailed on Dec. 1, 2023 for U.S. Appl. No. 18/354,014, 7 page (s).

* cited by examiner

STRING SHOOTING DEVICE

CROSS-REFERENCE TO RELATED APPLICATIONS

This application is a Continuation of and claims priority to U.S. patent application Ser. No. 19/093,482, filed on Mar. 28, 2025, which is a Continuation-in-Part of and claims priority to U.S. patent application Ser. No. 19/075,598, filed on Mar. 10, 2025, which claims priority to U.S. Provisional Application No. 63/692,214, filed on Sep. 9, 2024, and U.S. Provisional Application No. 63/562,770, filed on Mar. 8, 2024, the contents of each of which are hereby incorporated by reference in their entirety.

TECHNOLOGICAL FIELD

Example embodiments relate generally to a string shooting device, and more particularly, to a string shooting device that is wearable and operable by hand gestures or body movement.

BACKGROUND

String shooters that propel a flexible member such as a rope or string are known in the art. One type of string shooter is one that shoots a length of string out of a free-standing housing including a motor over a distance before landing. This type of string shooter is disclosed in https://www.youtube.com/watch?v=VRoyuOu5zhg and in use, the housing is supported on a surface, such as a table, and shoots a single length of a weighted string from the housing a certain distance. The string is weighted to enhance the distance that the string travels before landing. Once the string lands, it must be physically retrieved and then reloaded by hand to repeat the process.

Another known string shooting device utilizes a looped string that is continuously propelled through a pair of wheels to create sufficient lift to defy gravity and generate a continuous floating loop that can be manipulated by the user to do various aerial tricks. This type of string shooting device is available in a hand-held version that is disclosed in the following US patents, U.S. Pat. Nos. 11,674,774, 11,879,703, and 12,025,399, all of which are owned by the Applicant of the present invention. A larger, table-top version that creates a continuous floating loop, which is not intended to be hand-held for performing tricks is also known in the art, as disclosed in, for example https://www.youtube.com/watch?v=8ybXZqlDXak.

BRIEF SUMMARY

The present disclosure relates generally to a string shooting device, and more particularly, to a string shooting device including a body that is wearable and operable by hand gestures to propel, direct, and retrieve the string.

Embodiments provided herein include a device for propelling a string including: a body, a cavity; a pair of wheels supported by the body, where at least one wheel of the pair of wheels is a driven wheel; an actuator to activate and/or change the direction of movement of the driven wheel, for example a switch, selector, relay, controller or other type of sensor that when in a first position or setting, the driven wheel of the pair of wheels rotates in a first direction, where when in a second position or setting, the driven wheel of the pair of wheels rotates in a second direction, opposite the first direction.

According to some embodiments the pair of wheels are configured to propel a looped string in a direction away from the body of the device in response to the driven wheel rotating in the first direction. According to certain embodiments the pair of wheels are configured to propel the looped string toward the cavity in response to the driven wheel rotating in the second direction. The driven wheel of the pair of wheels of an example embodiment rotates in the second direction when the actuator is in the second position until at least a portion of the looped string is received within the cavity. In one exemplary embodiment, after being received within the cavity, at least a portion of the looped string remains between the pair of wheels.

According to some exemplary embodiments the driven wheel of the pair of wheels rotates in the second direction when the actuator is moved to the second setting or position for a predetermined amount of time. The driven wheel of the pair of wheels of an example embodiment rotates in the second direction when the actuator is in the second position until a torque force on the driven wheel exceeds a predetermined amount or threshold, at which time it stops rotating. According to some embodiments the pair of wheels are positioned on the body to rotate about parallel axes with a gap between the pair of wheels.

The device of some embodiments further includes a band attached to the body and configured to be removably attached to a body part of a user. According to some embodiments the actuator is a switch that is operable between the first position and the second position in response to a gesture made by a hand of the user. According to certain embodiments the gesture comprises a movement of at least one finger relative to other fingers of a hand of the user. The body of some embodiments includes an extension, where the band is worn about a wrist of the user in order to position the extension in a palm of the hand of the user, and wherein the switch is positioned on the extension.

Embodiments provided herein include a device for propelling a string including: a body including a cavity; a pair of wheels supported by the body, where at least one wheel of the pair of wheels is a driven wheel; an actuator configured to control the direction of the driven wheel between a first position wherein the driven wheel rotates in a first direction and a second position wherein the driven wheel rotates in a second direction, opposite the first direction; and a looped string, where the pair of wheels are configured to propel the looped string away from the body when the driven wheel rotates in the first direction, and where the pair of wheels are configured to drive the looped string into the cavity in response to the driven wheel rotating in the second direction.

The device of some embodiments further includes a band attached to the body to the device for propelling a looped string and configured to attach to a wrist of a user. The body of some embodiments includes an extension, where in response to the wrist band attached to the wrist of the user, the extension is received in a palm of the hand of the user, and wherein the actuator is positioned on the extension. According to some embodiments the pair of wheels are configured to drive the looped string into the cavity in response to the actuator moving the driven wheel into a direction toward the cavity until the looped string is received within the cavity. According to certain embodiments the pair of wheels are configured to drive the looped string into the cavity in response to the actuator being in a second position for a predetermined amount of time.

According to some embodiments the pair of wheels are configured to drive the looped string into the cavity in response the driven wheel rotating in the second direction until a torque force on the driven wheel exceeds a predetermined amount or threshold. The pair of wheels of some embodiments are positioned on the body to rotate about parallel axes with a gap between the pair of wheels.

Embodiments provided herein include a method of propelling a string including: receiving an indication that an actuator is in a first position; propelling a looped string in a first direction by a pair of wheels supported by a body in response to the actuator being in the first position, wherein the first direction is away from the body; receiving an indication that the actuator is in a second position; propelling the looped string in a second direction, opposite the first direction by at least the driven wheel supported by the body in response to the actuator being in the second position, wherein the second direction is opposite the first and direct the string into a cavity associated with the body. According to some embodiments the body is configured to be attached to a user, and where activation of the actuator to move the driven wheel between the first direction and the second direction is performed by a gesture.

Embodiments provided herein include a wearable device for propelling a string including: a string shooting device; a band configured to attach to a body part of a user; and a holder, where the holder is secured by the band to the user; where, in response to the body part of the user being in a first position, the string shooting device is not actuated, and where in response to the body part of the user being in a second position, the string shooting device is actuated. According to some embodiments, the body part of the user includes a hand, where the first position comprises an open hand, and where the second position comprises an at least partially closed position.

According to certain embodiments, the holder includes a sleeve, where the string shooting device is received within the sleeve and the sleeve is attached to the body part of the user, and where in response to the body part of the user being in the second position, the sleeve is compressed and presses against an actuation switch of the string shooting device. According to some embodiments, the holder comprises a loop of the band, where the string shooting device is received within the loop and the band is attached to the body part of the user, and where in response to the body part of the user being in the second position, the loop is compressed and presses, at least indirectly, against an actuation switch of the string shooting device.

Embodiments provided herein include a device for propelling a string including: a body comprising an extension; a pair of wheels attached to the body, wherein at least one wheel of the pair of wheels is a driven wheel, wherein the pair of wheels defines a gap therebetween, wherein a string is configured to be propelled through the gap by the driven wheel; at least one strap configured to attach to a wrist of a user; an actuator positioned on the extension, where the actuator is configured to cause the driven wheel to be driven in response to actuation, and where the actuator is positioned by the extension on a palm of the user in response to the at least one strap attaching to the wrist of the user.

The device of an example embodiment further includes a housing attached to the body, where the housing at least partially covers the pair of wheels, where the housing defines an exit aperture, and where the string is received into the gap and is propelled out of the exit aperture. The device of some embodiments further includes a cavity defined within the body, wherein the cavity is positioned on an opposite side of the gap from the exit aperture. According to some embodiments, in response to further actuation of the actuator, the driven wheel ceases to be driven in a first direction, and begins to be driven in a second direction, opposite the first direction.

The string of an example embodiment includes a looped string, and where in response to the driven wheel being driven in the second direction, the looped string is retrieved into the cavity. According to certain embodiments the pair of wheels are configured to propel a looped string away from the device in response to the driven wheel rotating in a first direction and retrieve the looped string into the cavity in response to the driven wheel rotating in a second direction, opposite the first direction.

According to some embodiments the driven wheel of the pair of wheels rotates in the first direction in response to a first interaction with the actuator and the driven wheel of the pair of wheels rotates in the second direction for a predetermined amount of time in response to a second interaction with the actuator. According to some embodiments the pair of wheels are attached at a first end of the body, and where the extension away from the body extends from the first end of the body.

The device of certain embodiments further includes a threading boss extending from the body, wherein the pair of wheels are disposed at a first end of the body, and where the threading boss extends from the first end of the body. The device of some embodiments further includes a housing, where the housing at least partially covers the pair of wheels, and where the housing defines a shape that extends from the body of the device to a loading slot aligned over the gap, wherein the housing slopes from the loading slot to the body.

Embodiments provided herein include a device for propelling a string including: a body; a pair of wheels attached to the body, wherein at least one wheel of the pair of wheels is a driven wheel, wherein the pair of wheels defines a gap therebetween, where a string is configured to be propelled through the gap by the driven wheel rotating in a first direction; at least one strap configured to attach to a wrist of a user; a housing at least partially covering the pair of wheels, where the housing defines an exit aperture through which the string is propelled; and an actuator, where the actuator is operable by the user using a hand associated with the wrist to cause the driven wheel to be driven in the first direction.

The device of some embodiments further includes an extension member extending away from the body, where the actuator is attached to the extension member. According to certain embodiments the extension member is hingedly attached to the body at a hinge. According to some embodiments the extension member is biased about the hinge toward a side of the body opposite a side of the body on which the pair of wheels are attached. According to certain embodiments the extension member is configured to align with a palm of a user in response to the device being attached to an inside of the wrist of the user with the at least one strap, and where the extension member is biased into the palm of the user.

The device of certain embodiments includes a cavity at least one of defined within the body or attached to the body, wherein the cavity is positioned on an opposite side of the gap from the exit aperture. According to some embodiments the pair of wheels are configured to propel a looped string through the exit aperture away from the device in response to the driven wheel rotating in the first direction and retrieve the looped string into the cavity in response to the driven wheel rotating in a second direction, opposite the first direction.

According to certain embodiments the driven wheel of the pair of wheels rotates in the first direction in response to a first interaction with the actuator and the driven wheel of the pair of wheels rotates in the second direction for a predetermined amount of time in response to a second interaction with the actuator. The device of some embodiments includes a threading boss extending from the body, where the pair of wheels are disposed at a first end of the body, and wherein the threading boss extends from the first end of the body. The device of certain embodiments includes a housing, wherein the housing at least partially covers the pair of wheels, and wherein the housing defines a shape that extends from the body of the device to a loading slot aligned over the gap, wherein the housing slopes from the loading slot to the body.

BRIEF DESCRIPTION OF THE DRAWINGS

Having thus described embodiments of the disclosure in general terms, reference will now be made to the accompanying drawings, which are not necessarily drawn to scale. The following drawings are illustrative of exemplary embodiments of the present disclosure and do not limit the scope of the present disclosure. Moreover, the drawings are intended for use in conjunction with the explanations provided herein. Example embodiments of the present disclosure will hereinafter be described in conjunction with the appended drawings.

Figure 1:
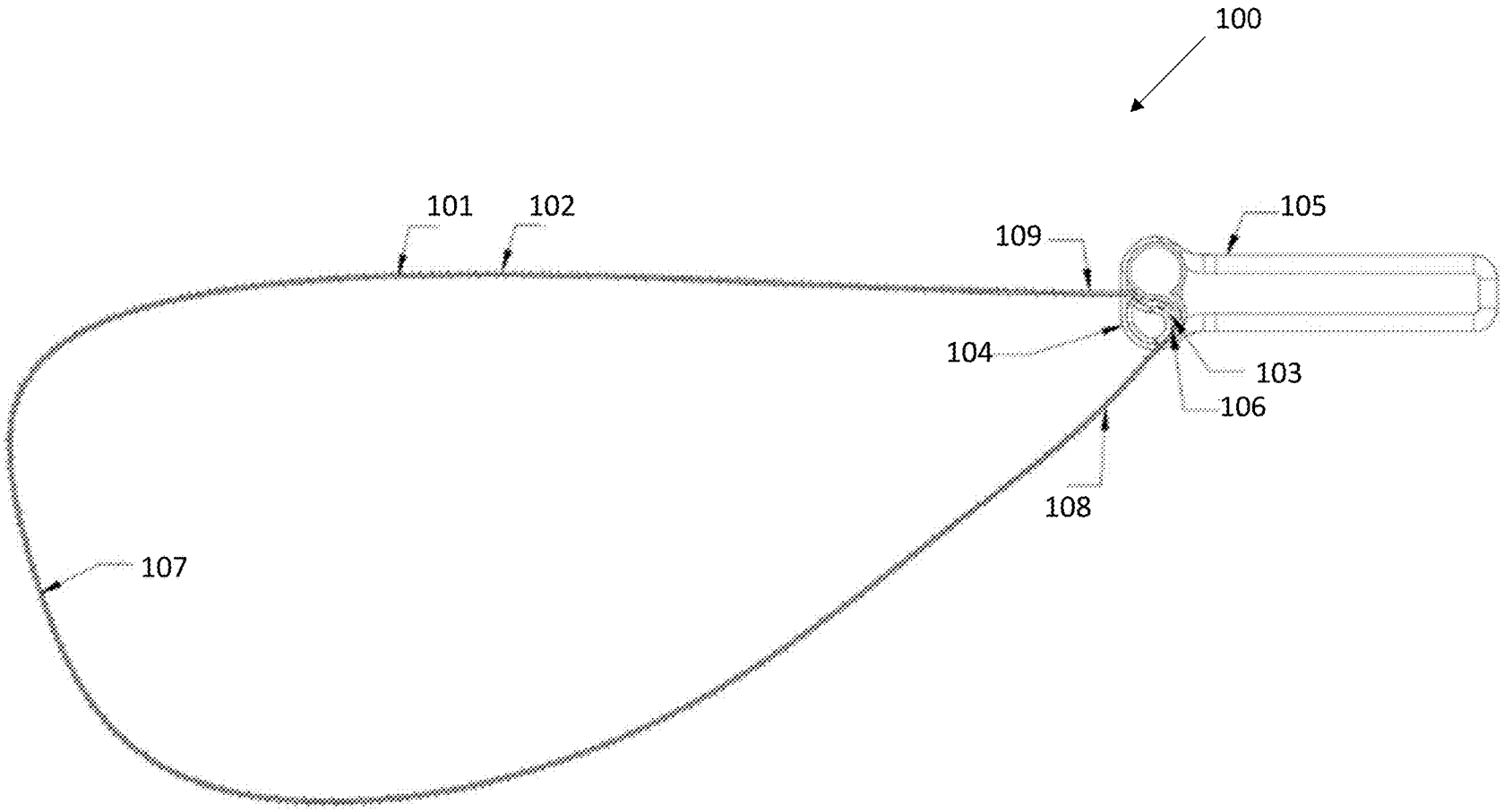
Figure 2:
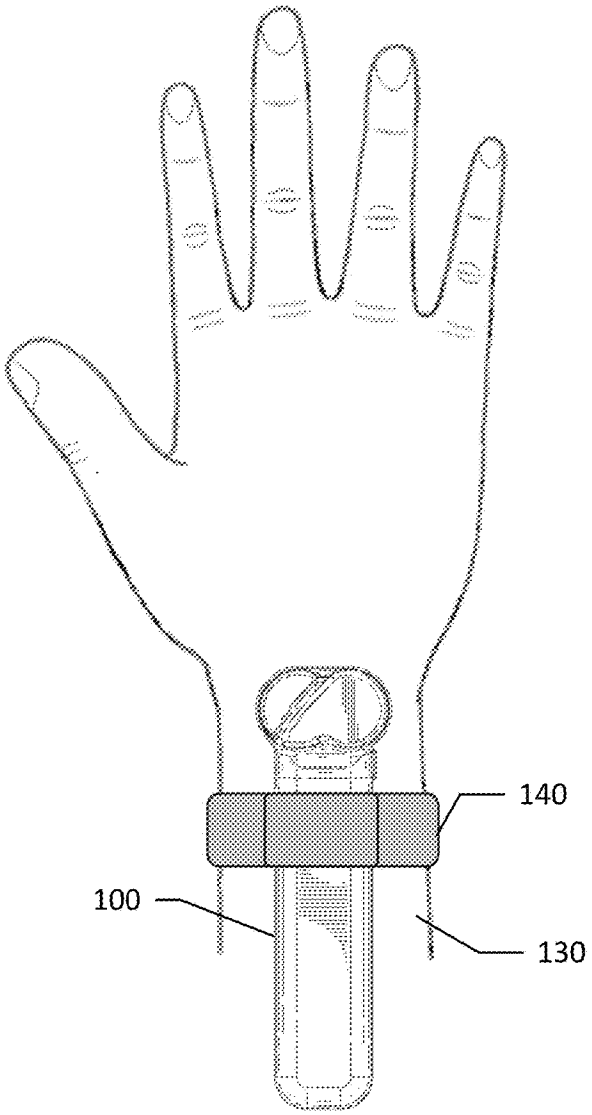
Figure 3:
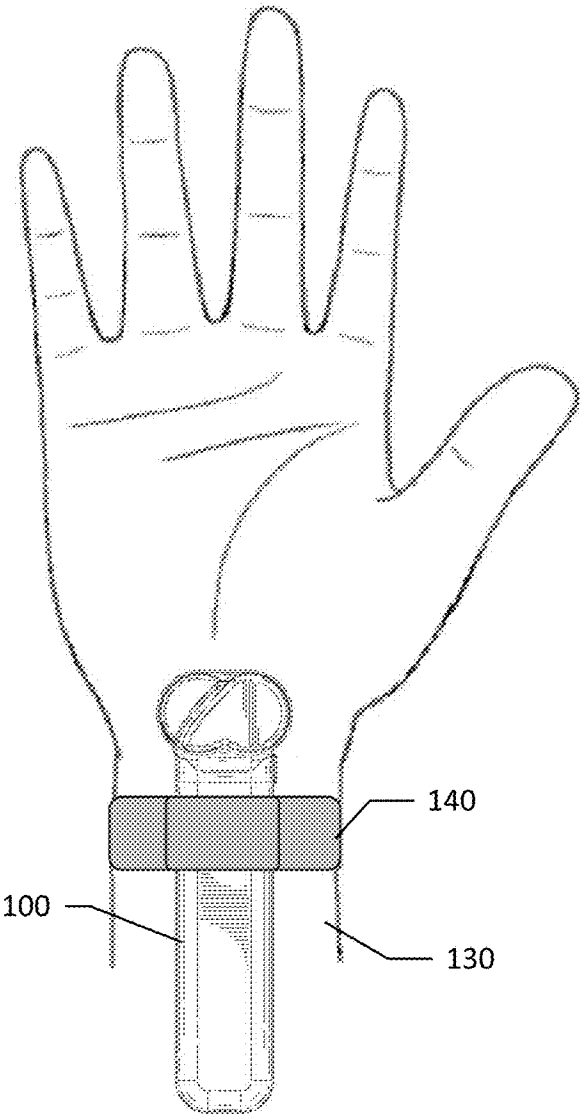
Figure 4:
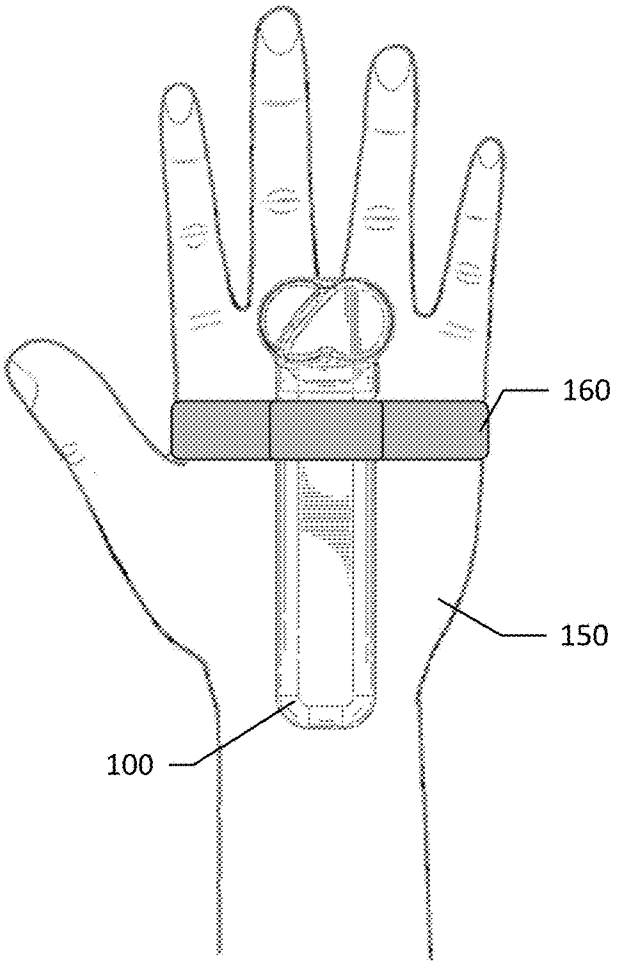
Figure 5:
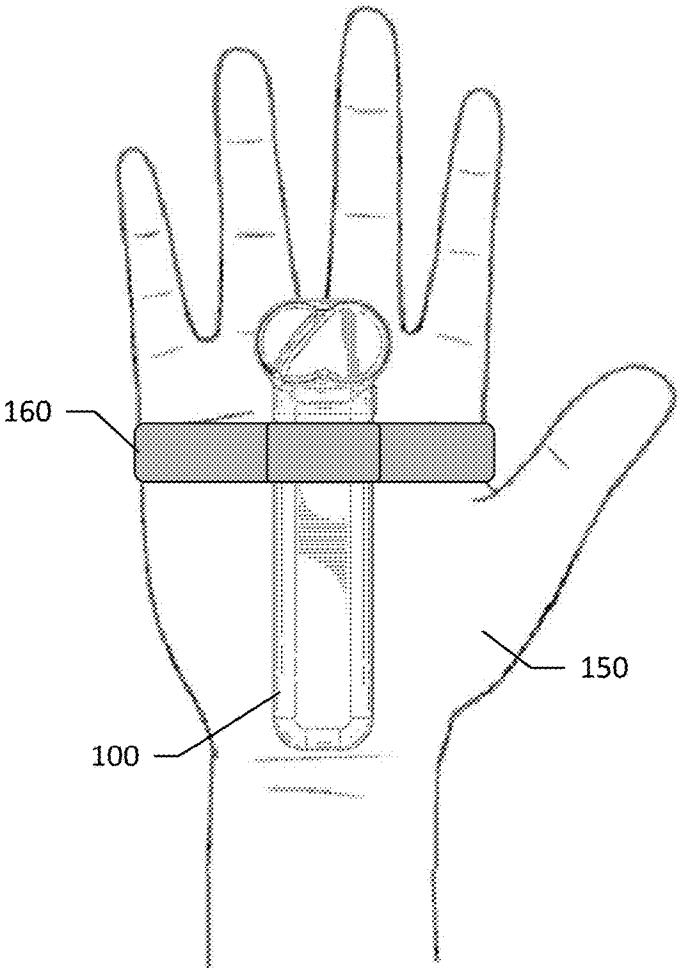
Figure 6:
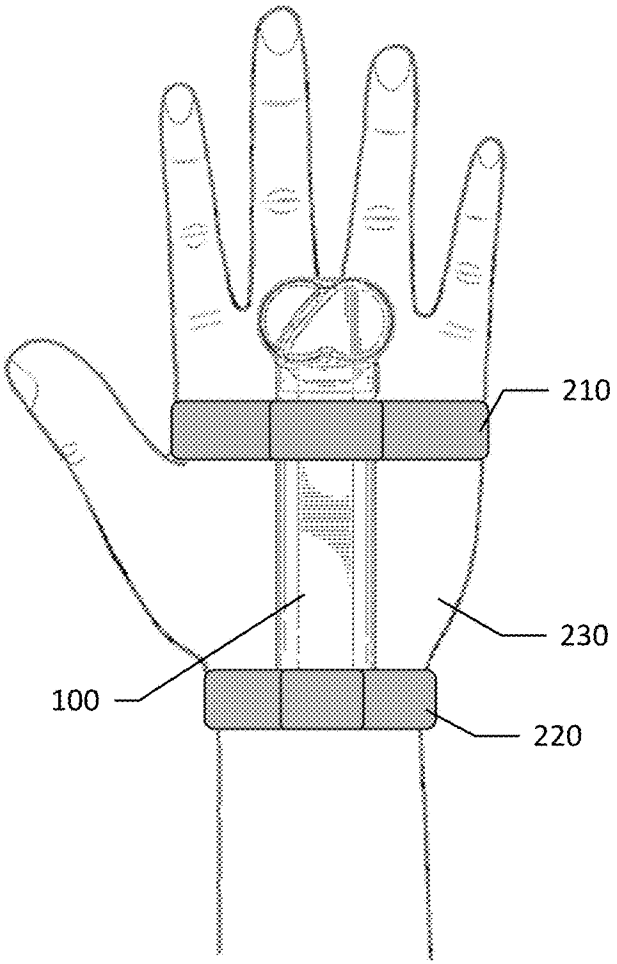
Figure 7:
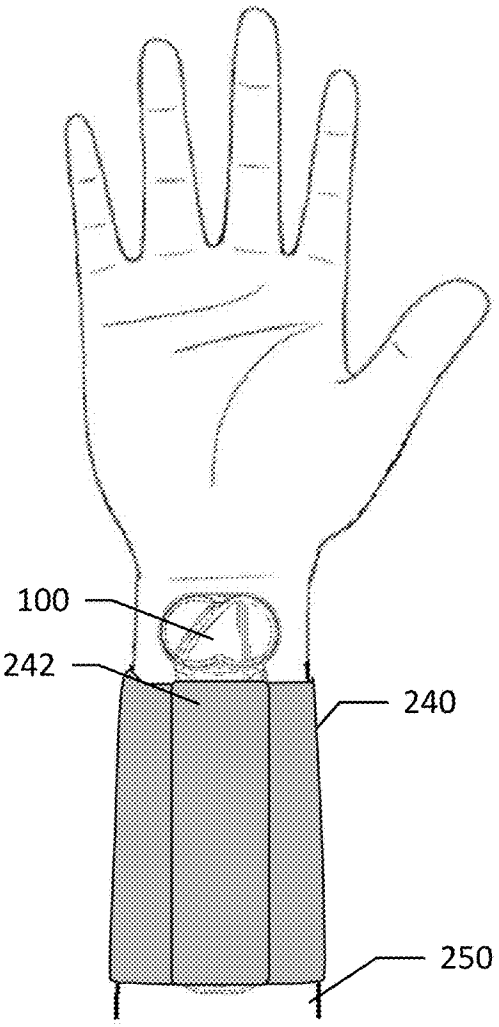
Figure 8:
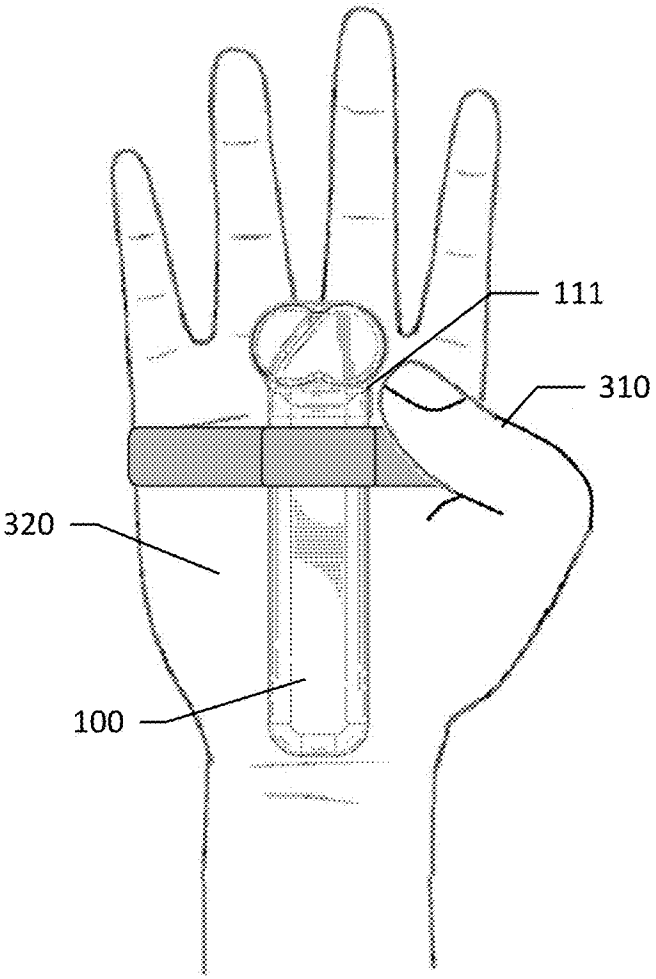
Figure 9:
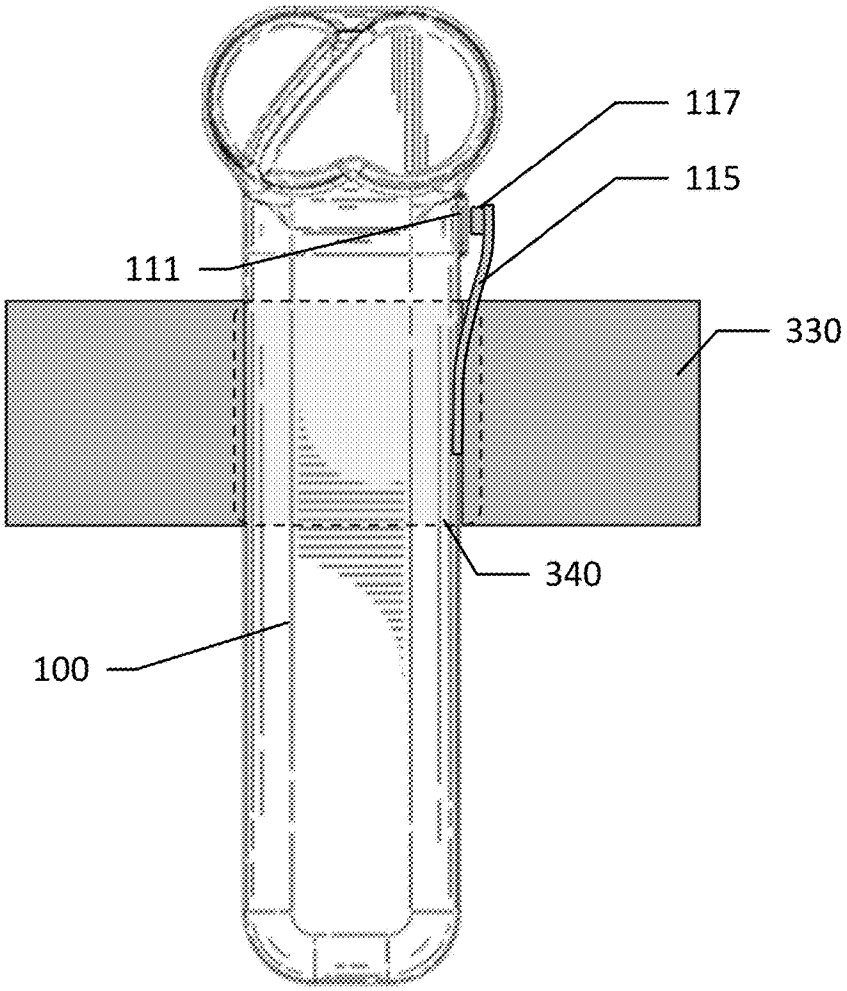
Figure 10:
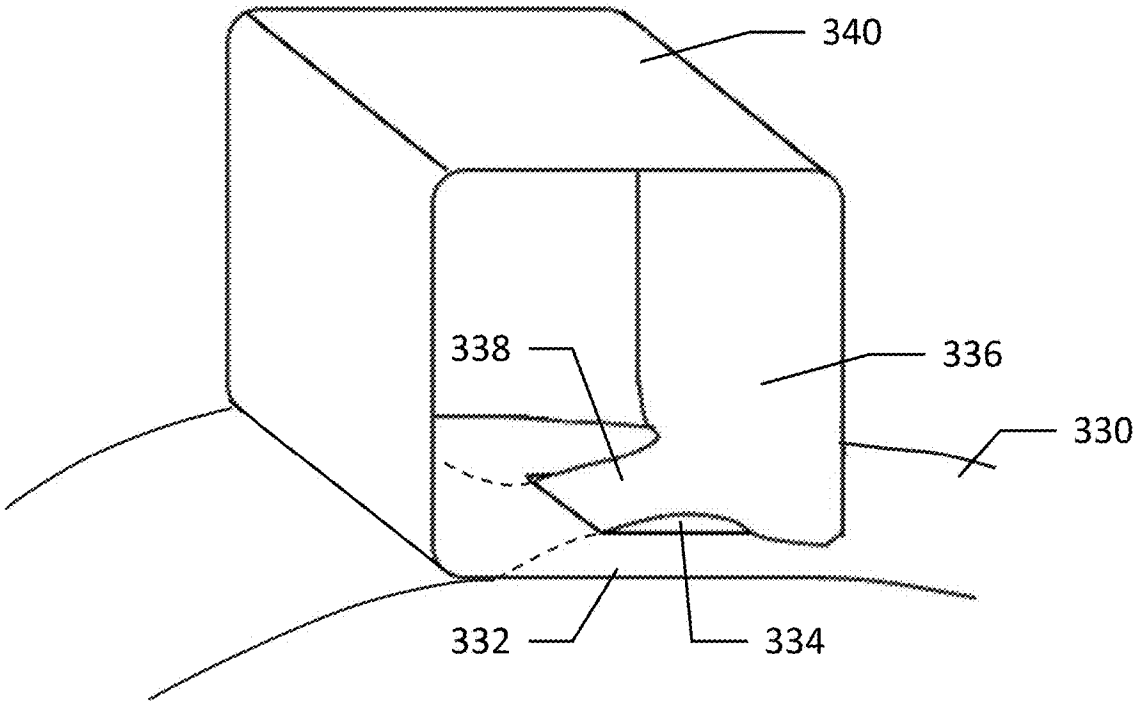
Figure 11:
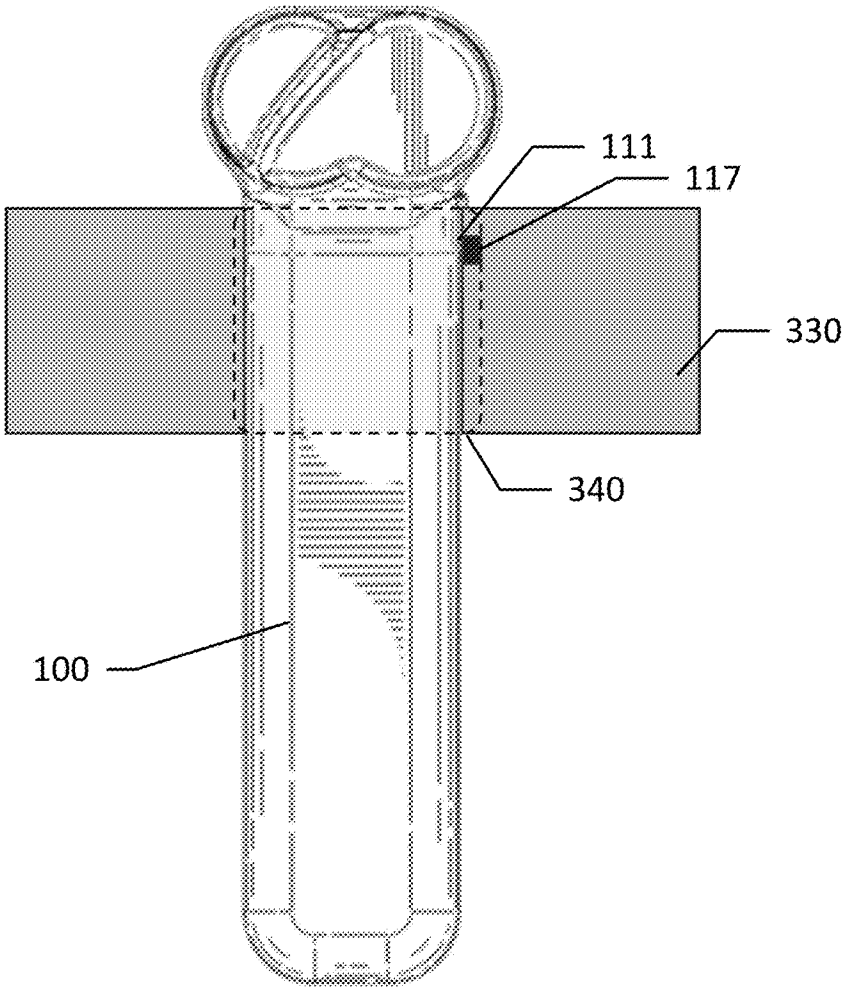
Figure 12:
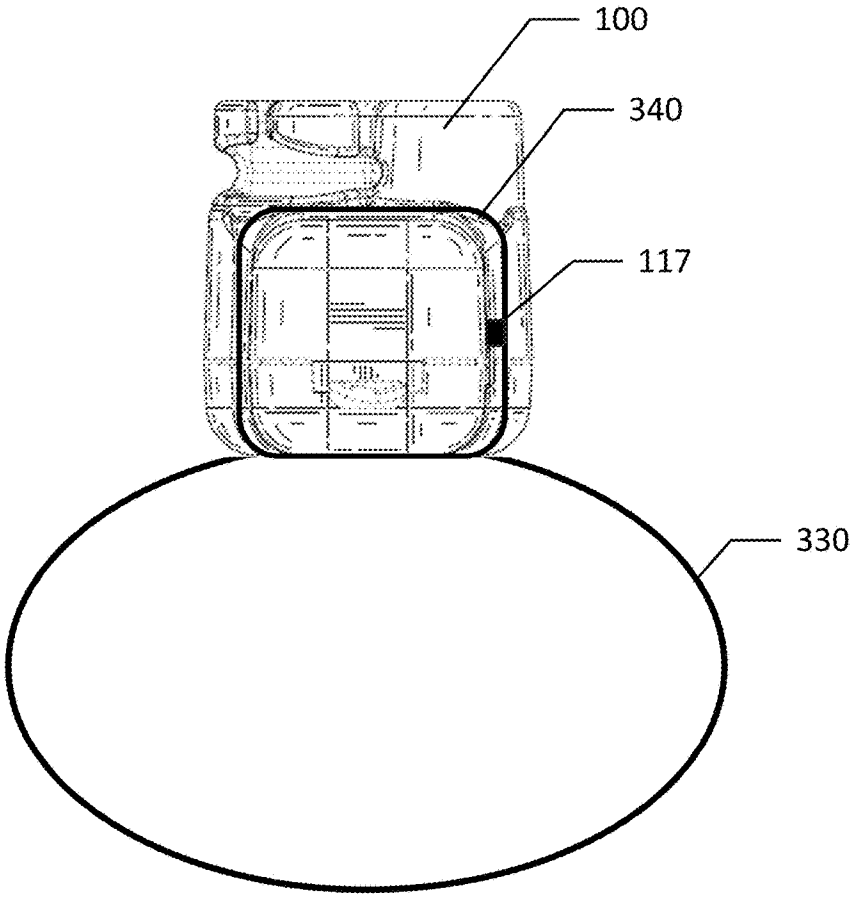
Figure 13:
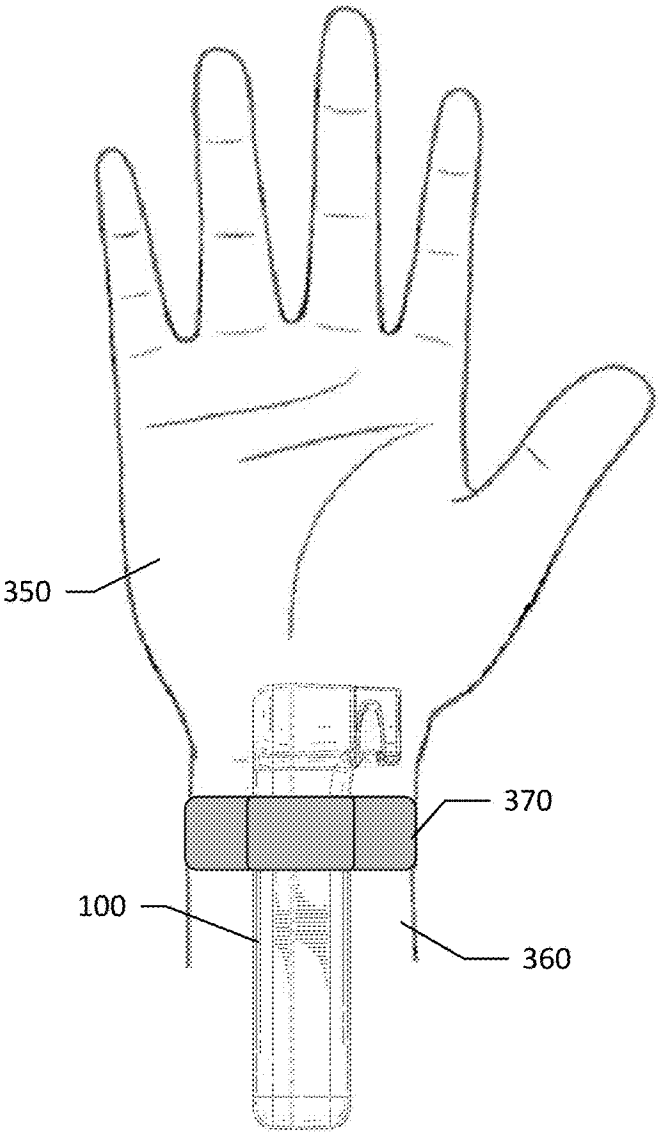
Figure 14:
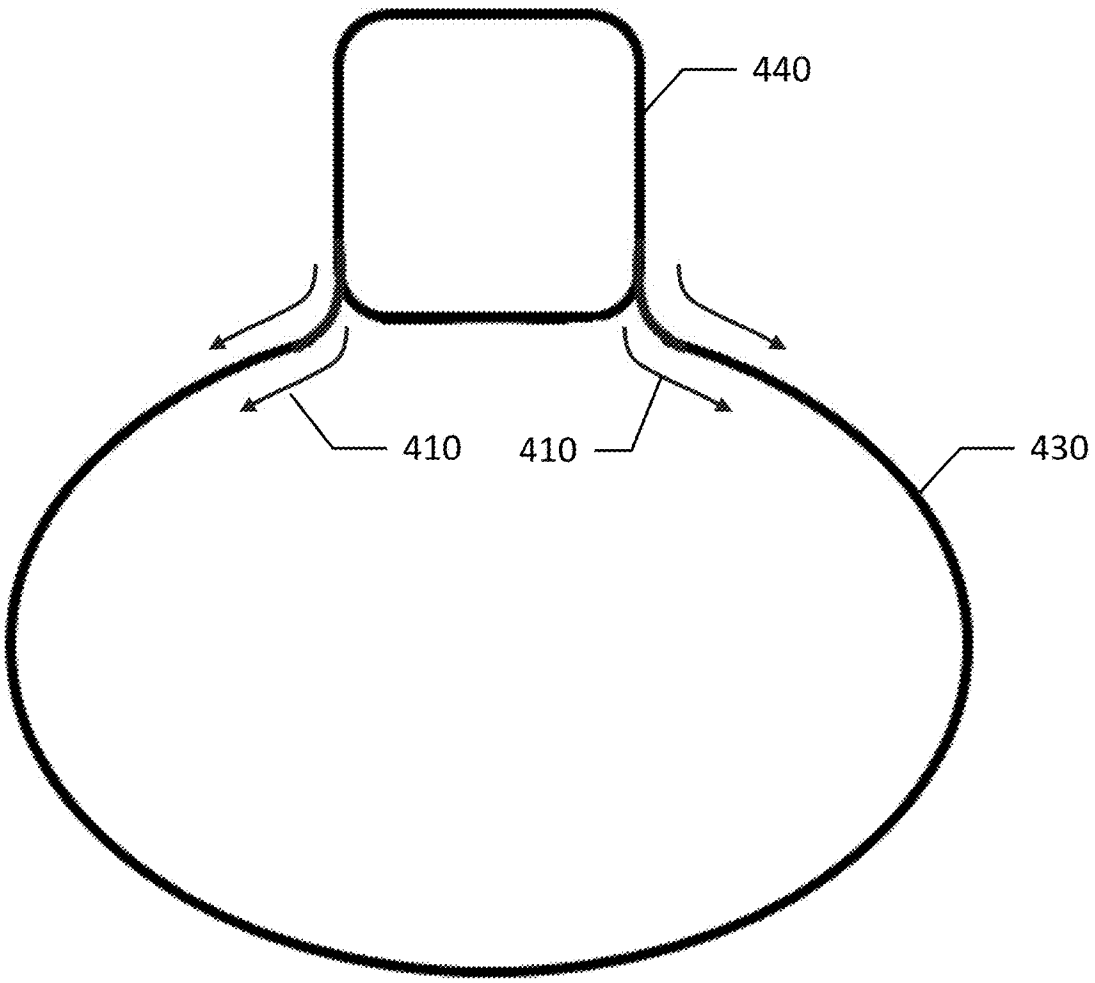
Figure 15:
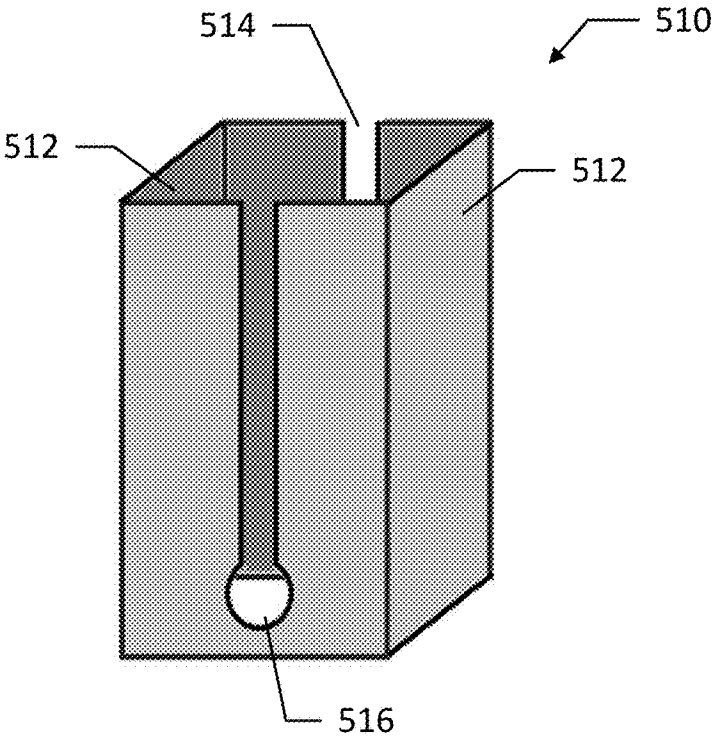
Figure 15:
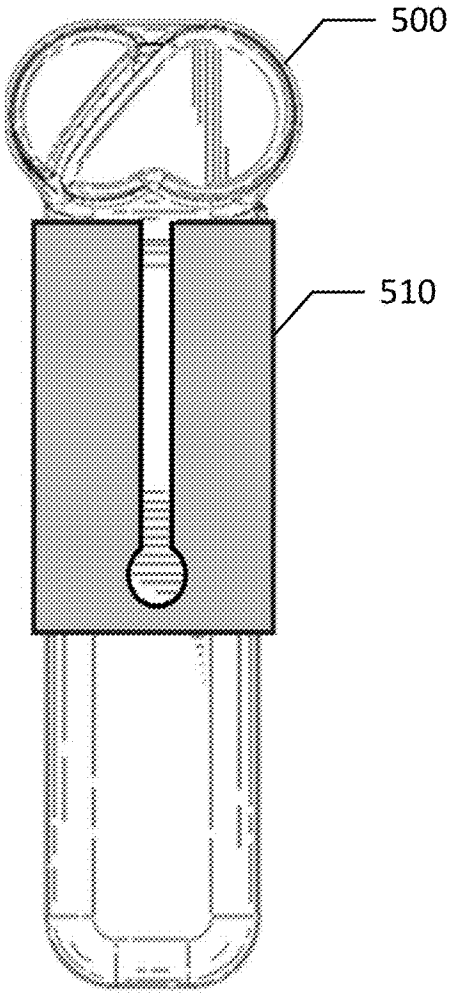
Figure 16:
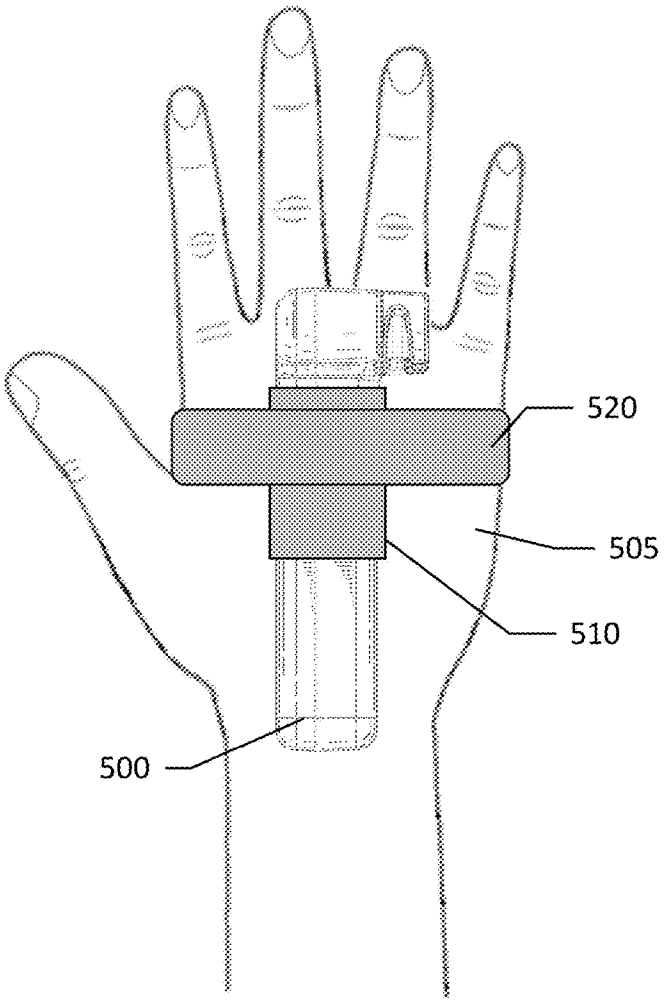
Figure 17:
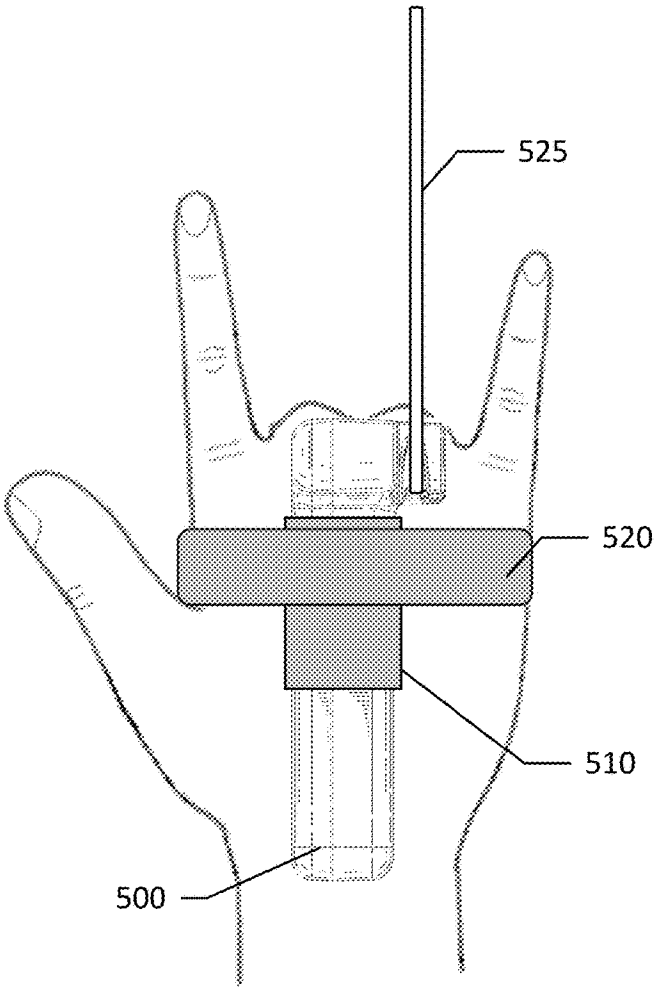
Figure 18:
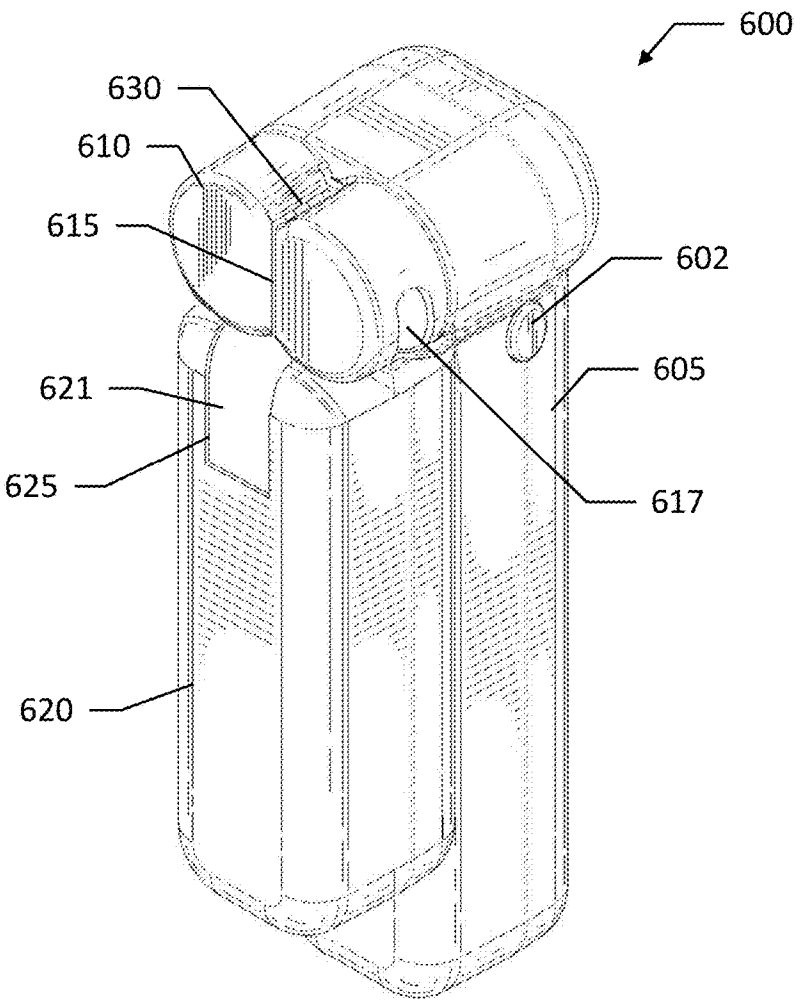
Figure 19:
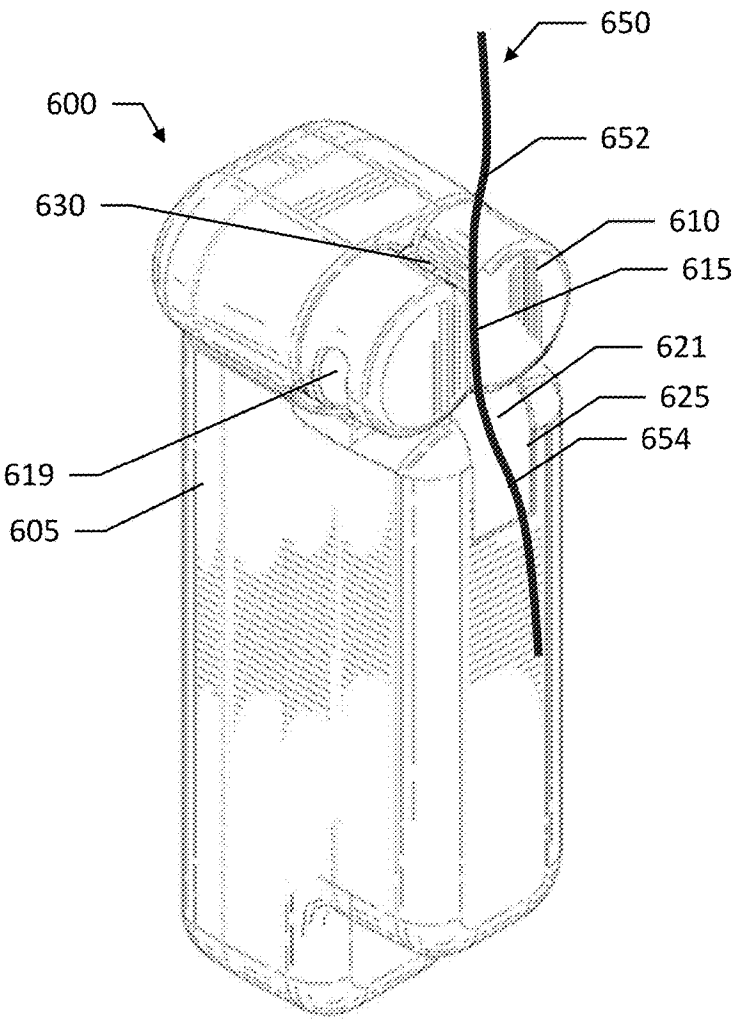
Figure 20:
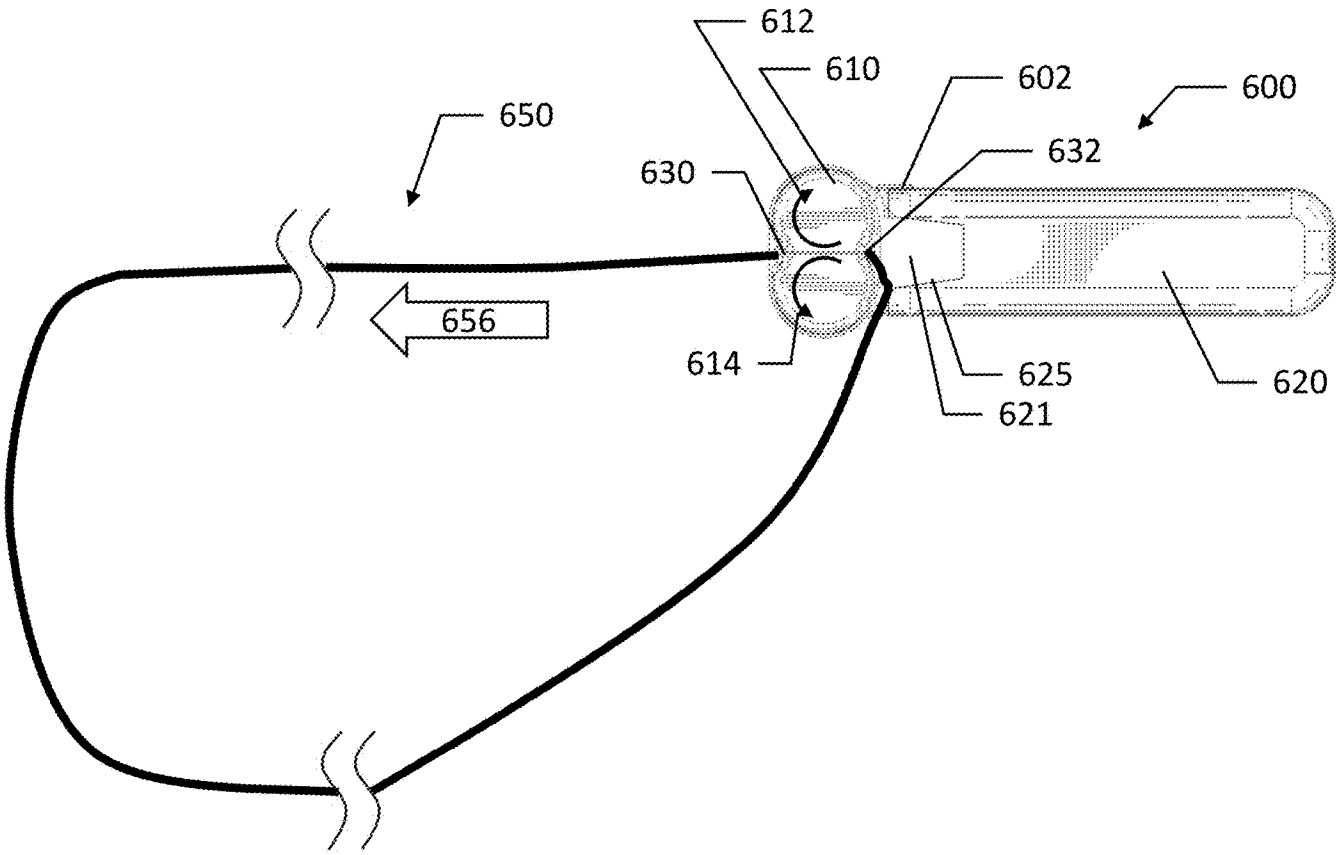
Figure 21:
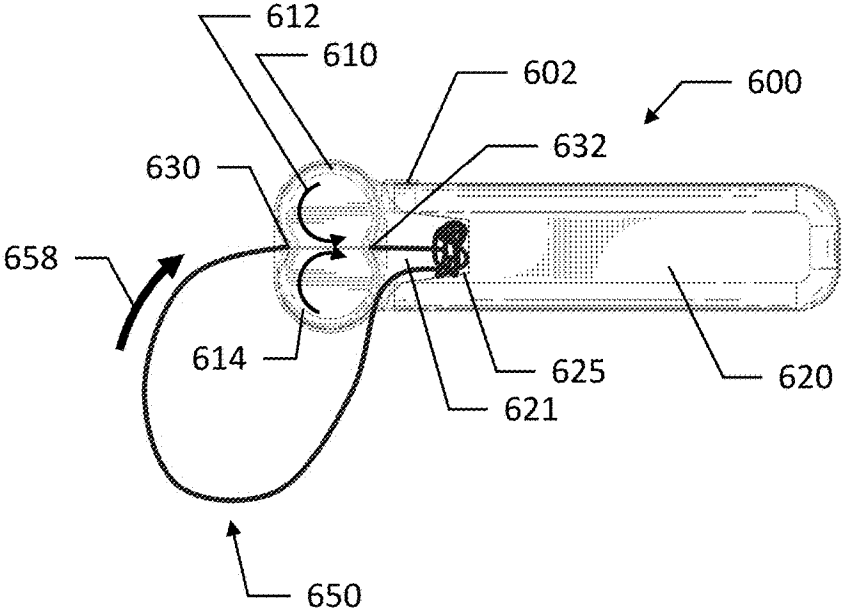
Figure 22:
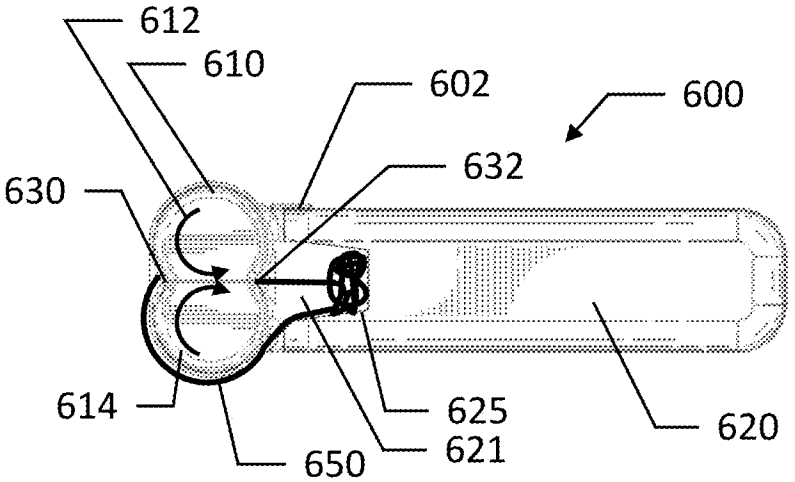
Figure 23:
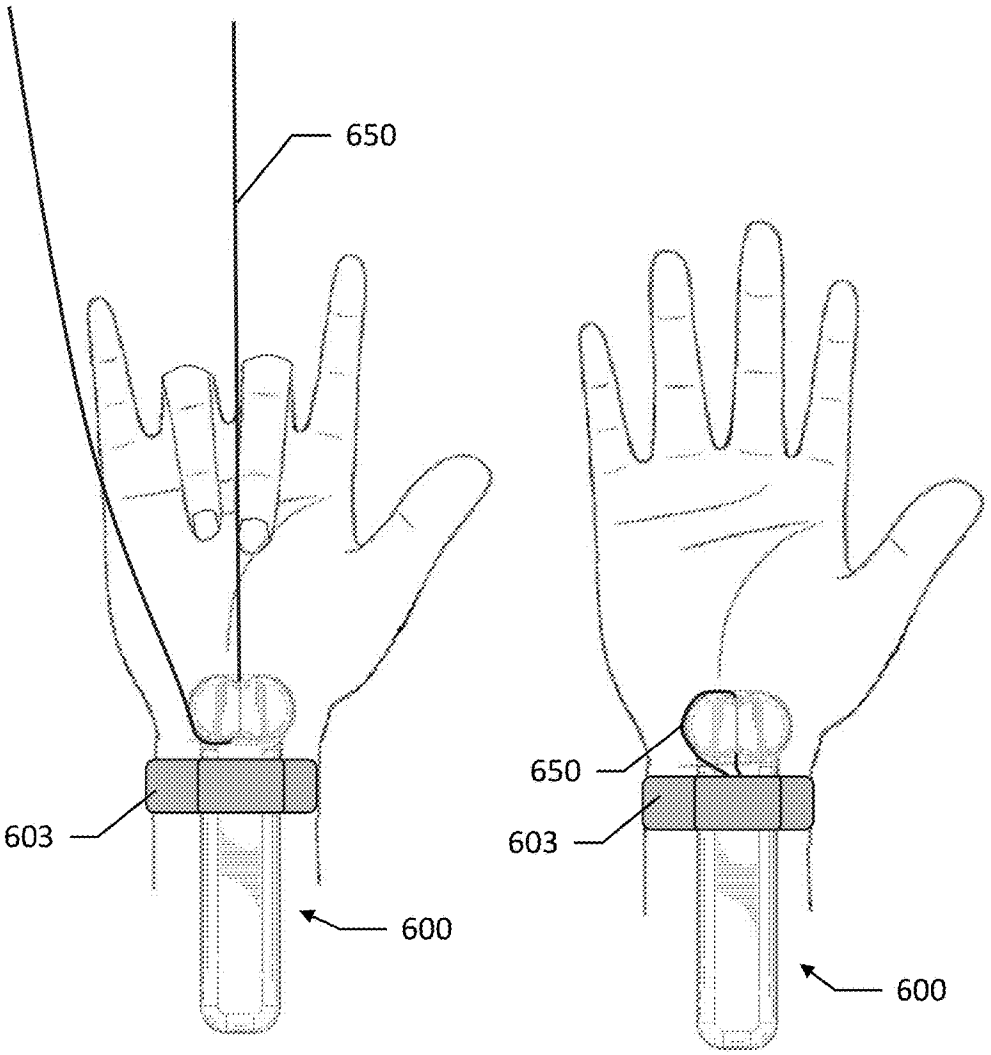
Figure 24:
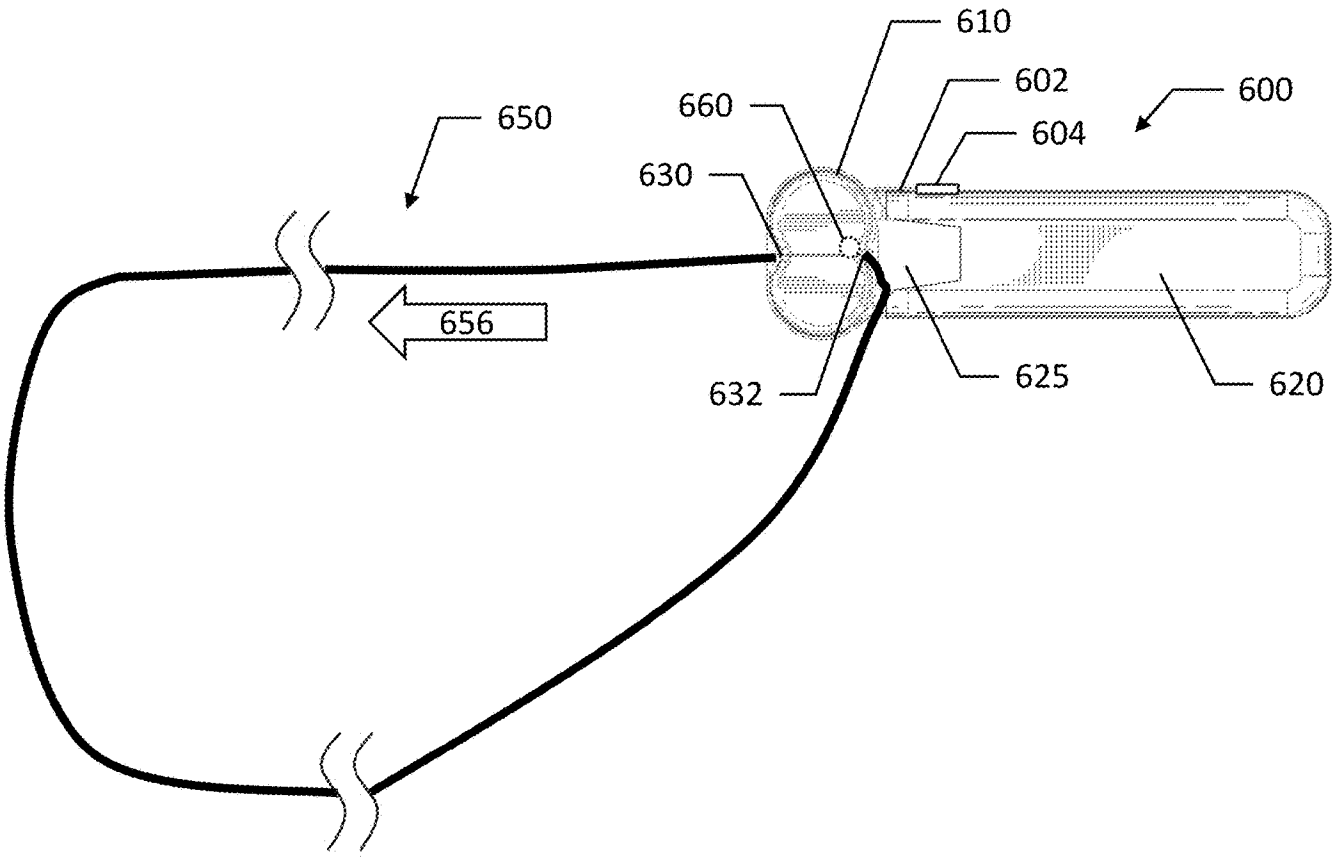
Figure 25:
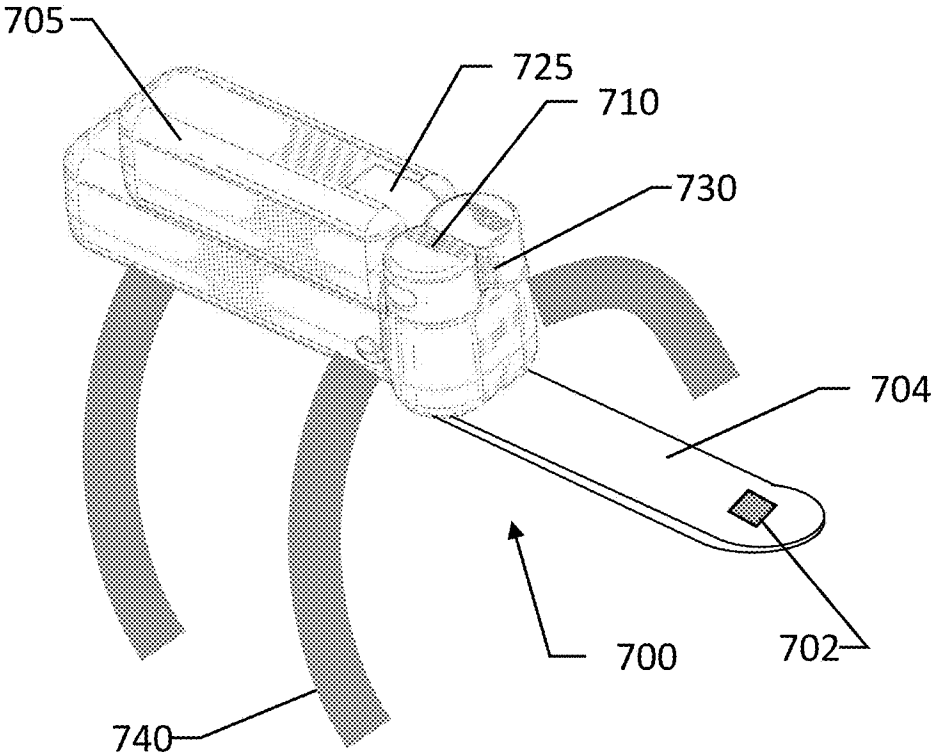
Figure 26:
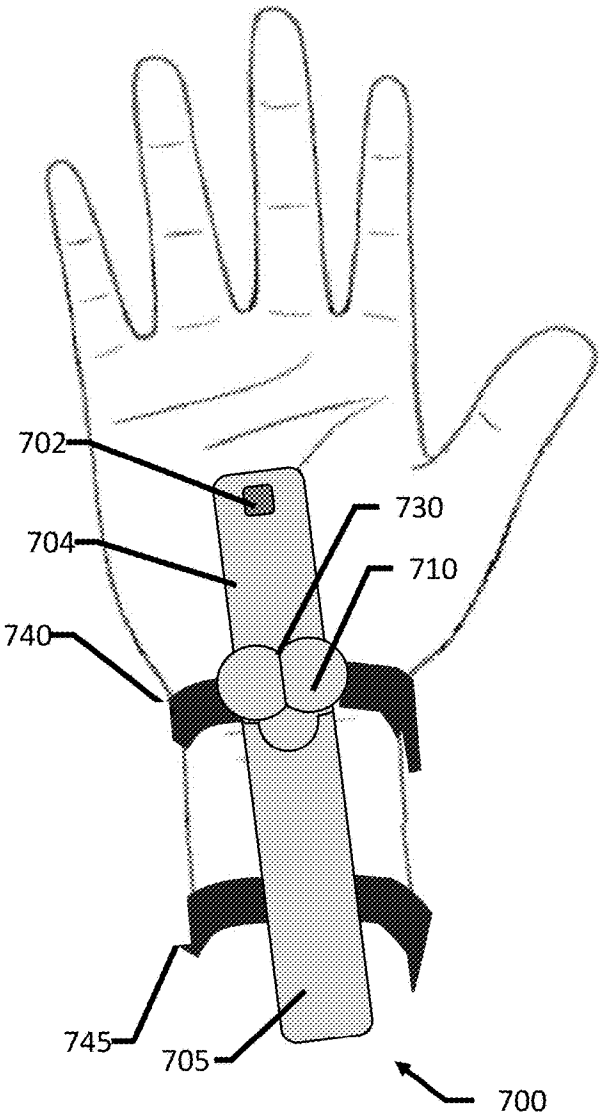
Figure 27:
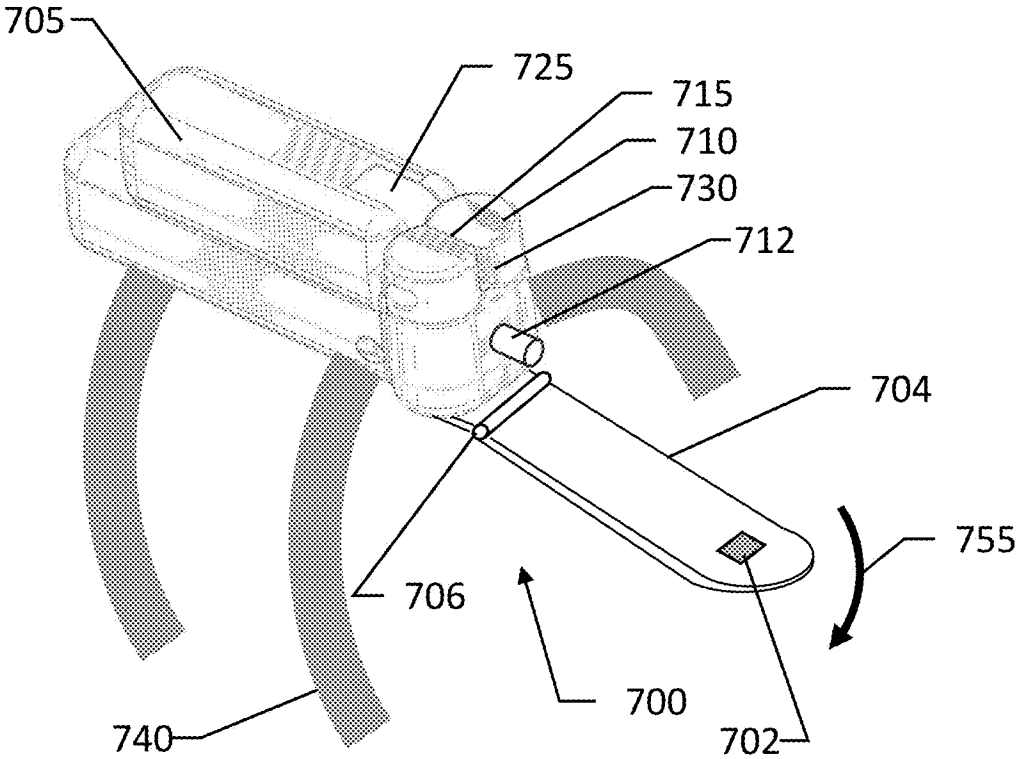
Figure 28:
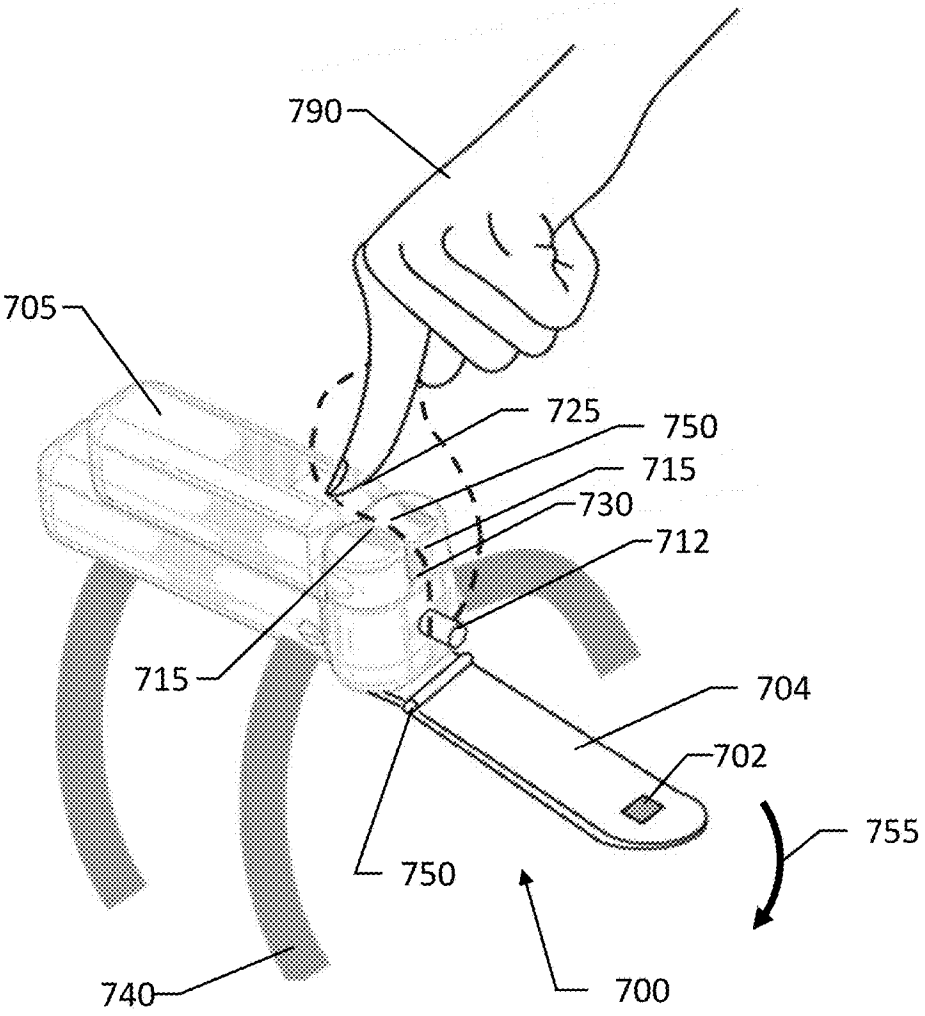
Figure 29:
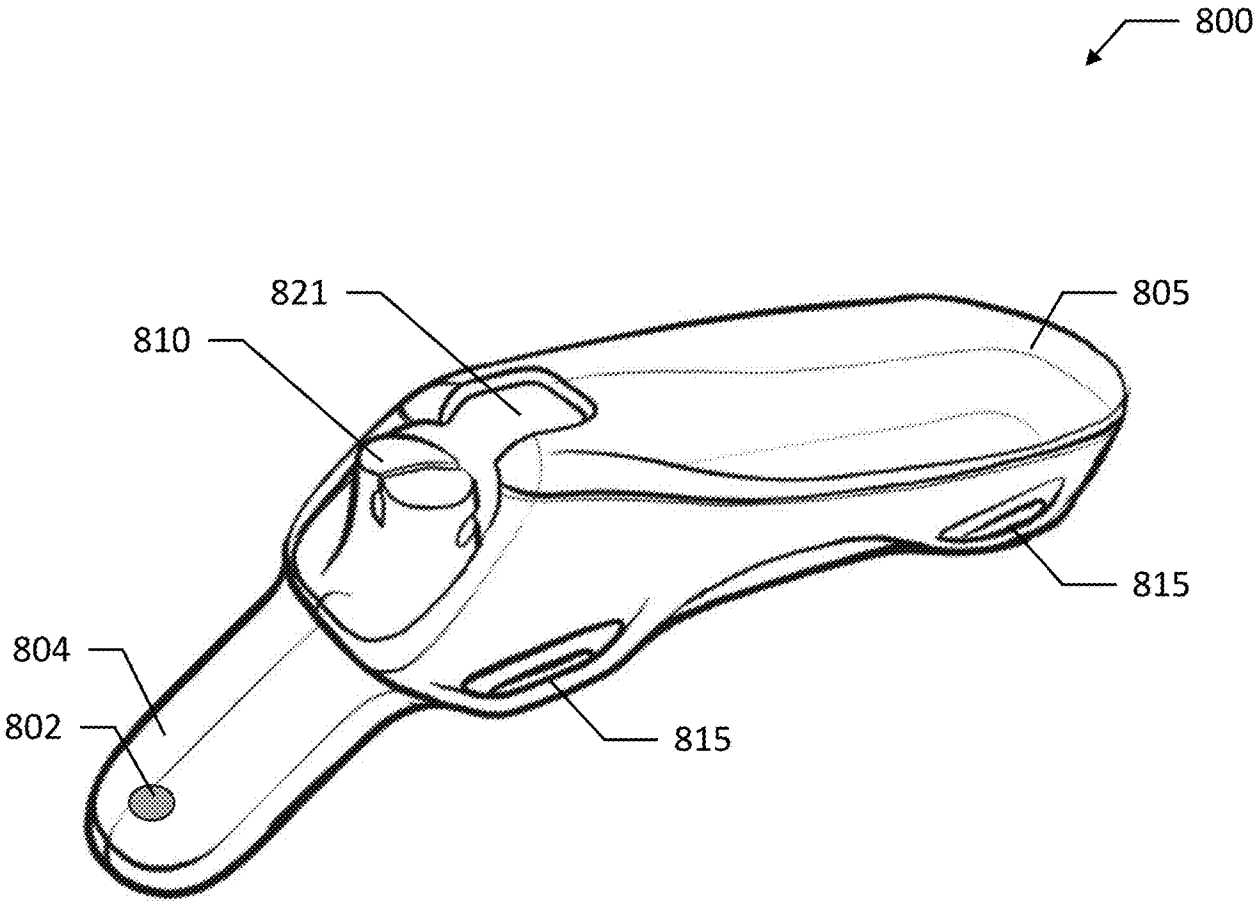
Figure 30:
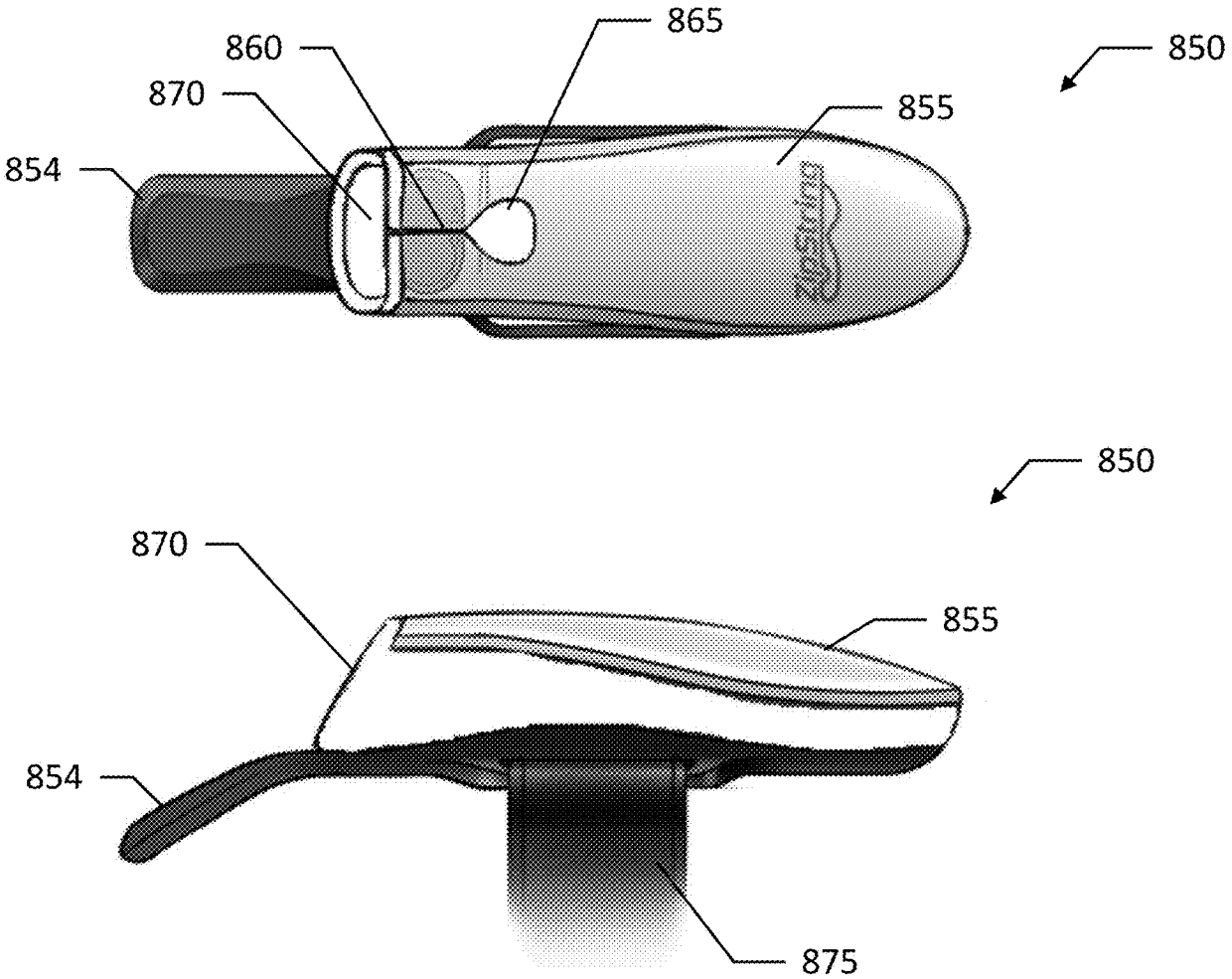
Figure 31:
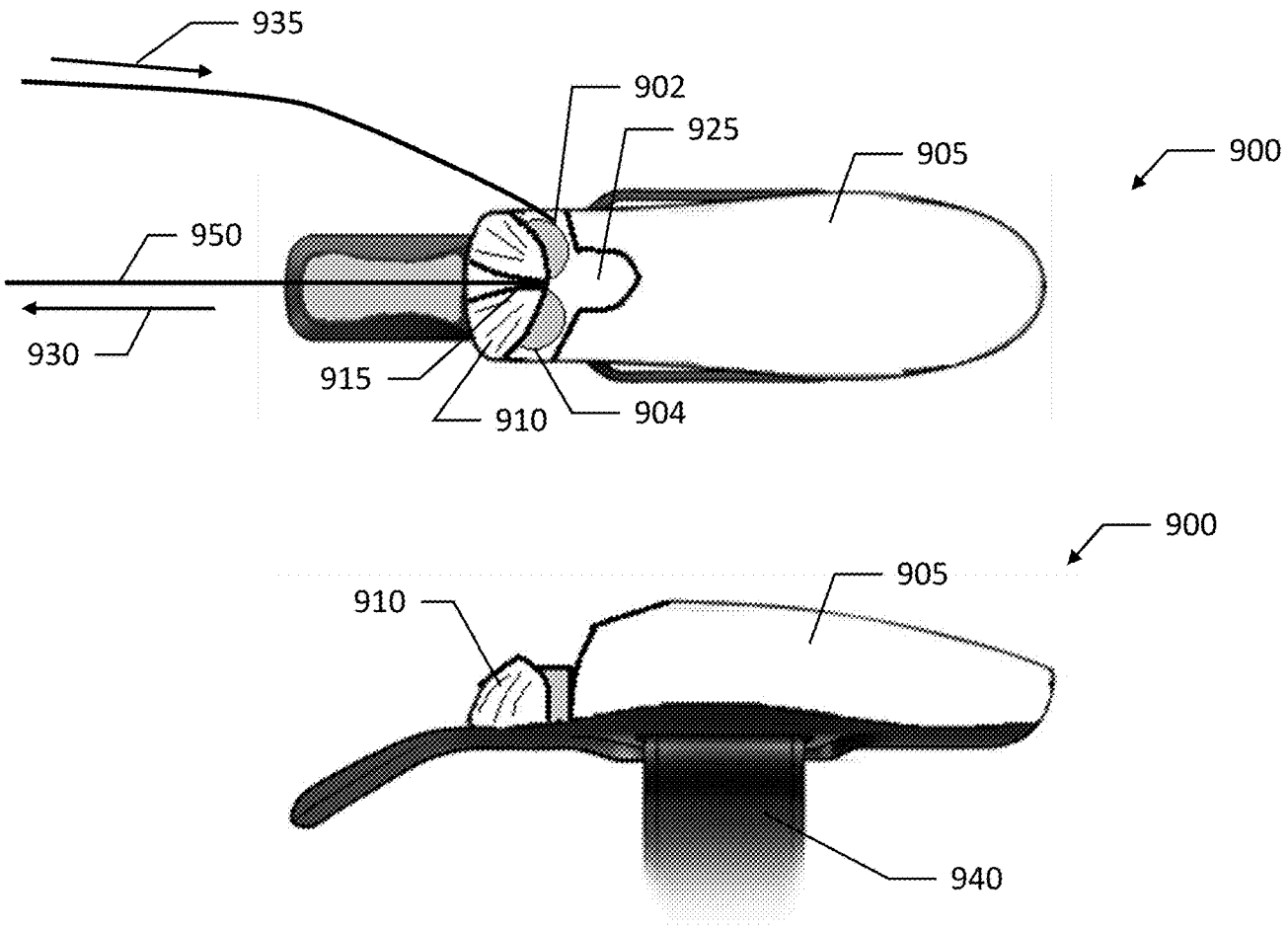
Figure 32:
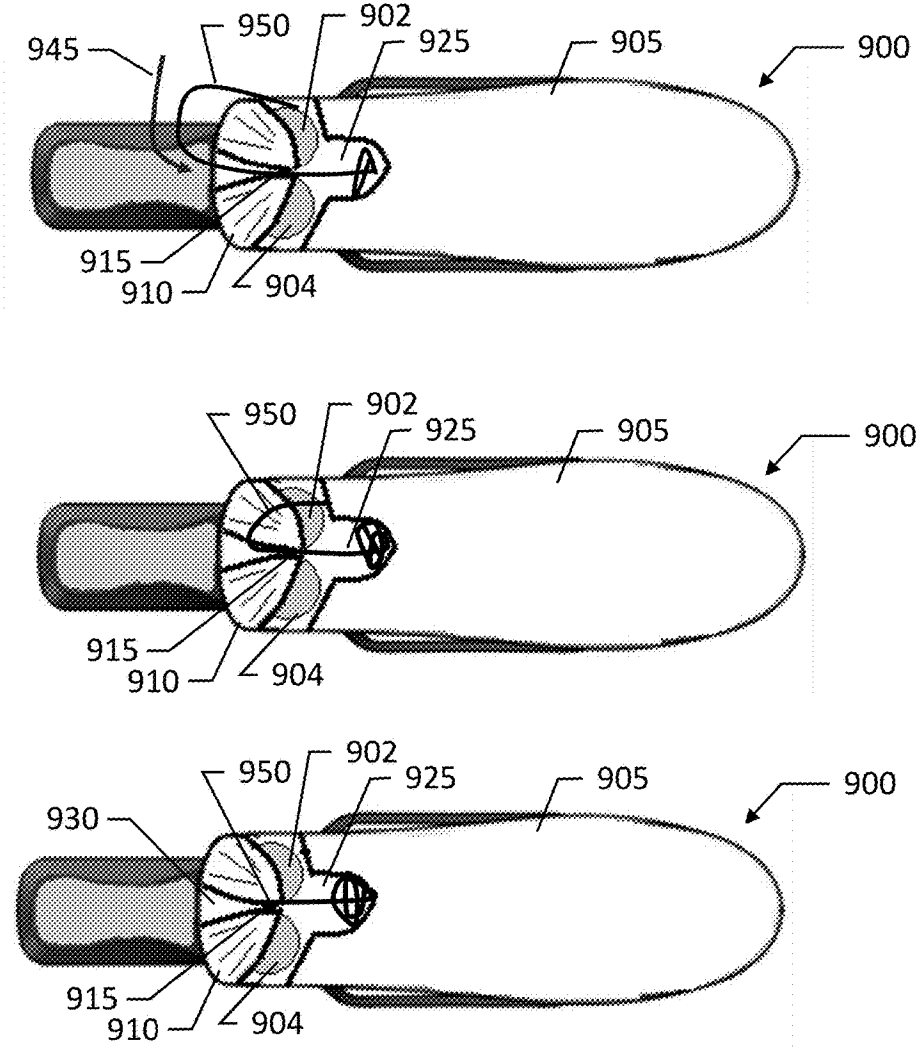
Figure 33:
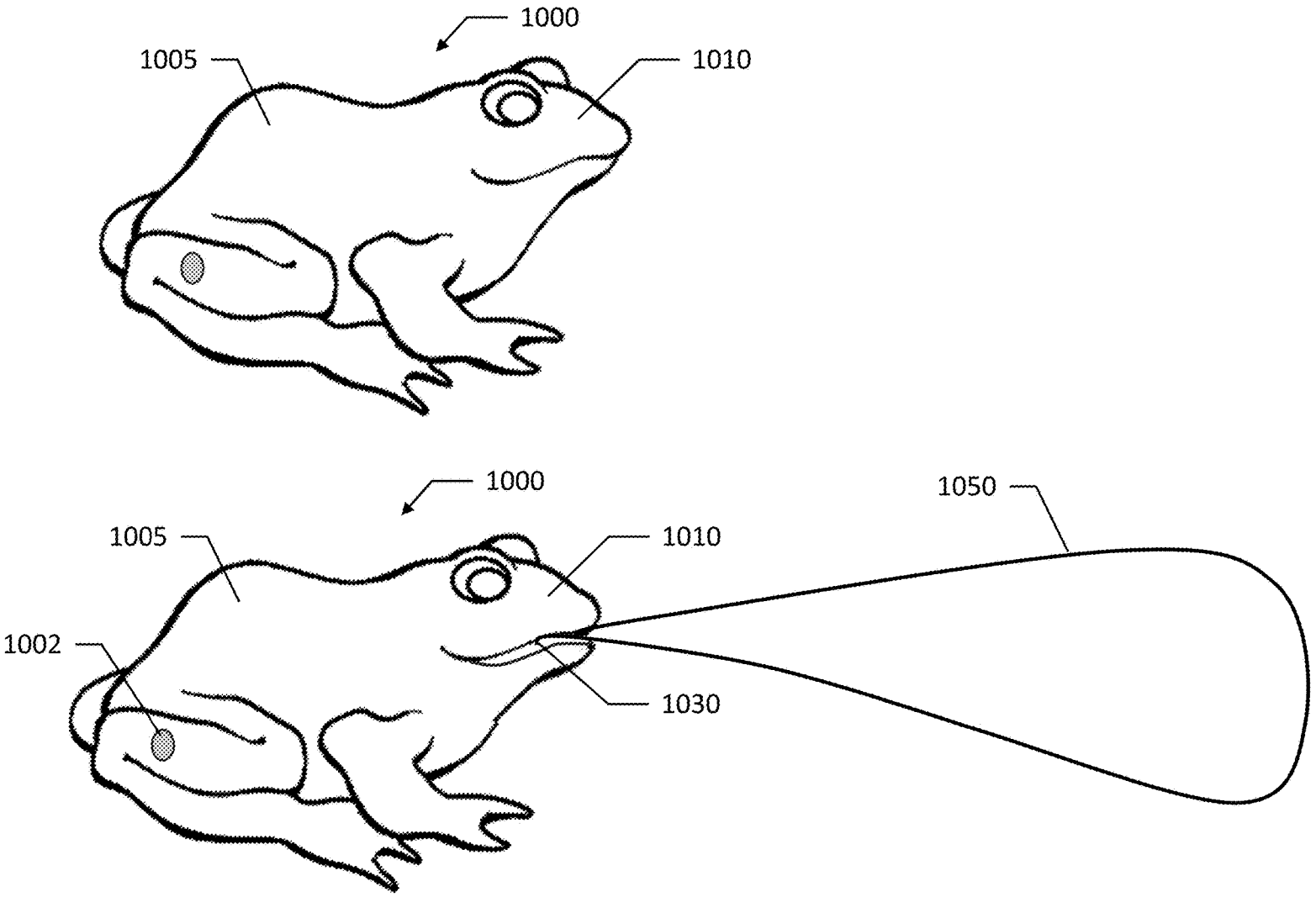

FIG. 1 illustrates a profile view of a string shooter propelling a looped string according to an example embodiment of the present disclosure;

FIG. 2 illustrates a string shooting device as a wrist worn device secured to a back of a user's wrist according to an example embodiment of the present disclosure;

FIG. 3 illustrates a string shooting device as a wrist worn device secured to the front of a user's wrist according to an example embodiment of the present disclosure;

FIG. 4 illustrates another embodiment of a string shooting device as worn on a back of a hand according to an example embodiment of the present disclosure;

FIG. 5 illustrates yet another embodiment of a string shooting device as worn on the front of a hand and attached to the hand by a band according to an example embodiment of the present disclosure;

FIG. 6 illustrates a string shooting device worn by a hand using a palm band and a wrist band according to an example embodiment of the present disclosure;

FIG. 7 illustrates a string shooting device worn by a forearm using a sleeve band according to an example embodiment of the present disclosure;

FIG. 8 illustrates how a palm-worn string shooting device can be actuated, where a user folds their thumb into their palm and presses a switch of the device to actuate the propulsion of the string according to an example embodiment of the present disclosure;

FIG. 9 illustrates a mechanism for actuating the string shooting device that does not require the use of a finger to depress the switch according to an example embodiment of the present disclosure;

FIG. 10 illustrates a portion of the band and loop of the embodiment of FIG. 9, with the string shooting device removed for ease of understanding;

FIG. 11 illustrates another example embodiment in which the pad is not attached to an arm as in FIG. 9 but is instead attached inside the loop according to an example embodiment of the present disclosure;

FIG. 12 illustrates the embodiment of FIG. 11 viewed from a bottom of the string shooting device according to an example embodiment of the present disclosure;

FIG. 13 illustrates a different orientation of the string shooting device relative to a wrist of a wearer according to an example embodiment of the present disclosure;

FIG. 14 illustrates another embodiment of a configuration of a band for applying pressure to a loop according to an example embodiment of the present disclosure;

FIG. 15 illustrates a string shooting device and a sleeve into which the string shooting device is received according to an example embodiment of the present disclosure;

FIG. 16 illustrates the embodiment of FIG. 15 as worn by a user around a hand according to an example embodiment of the present disclosure;

FIG. 17 illustrates an example embodiment of a hand actuating the string shooting device and propelling the string by closing two fingers of the hand, which tensions the band and actuates the string shooting device according to an example embodiment of the present disclosure;

FIG. 18 illustrates a device including a cavity to hold retrieved looped string according to an example embodiment of the present disclosure;

FIG. 19 illustrates a loading technique for a device employing a cavity and a opening according to an example embodiment of the present disclosure;

FIG. 20 illustrates a device with a cavity for the looped string actively propelling the looped string according to an example embodiment of the present disclosure;

FIG. 21 illustrates a device with a cavity for the looped string as string is being retrieved into a cavity of the cavity according to an example embodiment of the present disclosure;

FIG. 22 illustrates the looped string fully retrieved into the cavity of the cavity according to an example embodiment of the present disclosure;

FIG. 23 depicts actuation of the device propelling the looped string and full retrieval of the looped string once actuation is ceased according to an example embodiment of the present disclosure;

FIG. 24 illustrates a device with a cavity for the looped string including a light source to illuminate at least a portion of a path of the string according to an example embodiment of the present disclosure;

FIG. 25 illustrates an embodiment of a wrist worn device for propelling looped string with a cavity for retrieved string according to an example embodiment of the present disclosure;

FIG. 26 illustrates another view of the embodiment of a wrist worn device for propelling looped string with a cavity for retrieved string according to an example embodiment of the present disclosure;

FIG. 27 illustrates another embodiment of a wrist worn device for propelling looped string according to an example embodiment of the present disclosure;

FIG. 28 illustrates the embodiment of the wrist worn device of FIG. 27 with a method of threading the looped string into the device according to an example embodiment of the present disclosure;

FIG. 29 illustrates an embodiment of a wrist worn device for propelling a looped string with a unitary housing according to an example embodiment of the present disclosure;

FIG. 30 illustrates another embodiment of a wrist worn device for propelling a looped string with a unitary housing according to an example embodiment of the present disclosure;

FIG. 31 illustrates another embodiment of a wrist worn device for propelling a looped string with a unitary housing according to an example embodiment of the present disclosure;

FIG. 32 illustrates the embodiment of FIG. 31 during the process of retracting the looped string according to an example embodiment of the present disclosure; and FIG. 33 illustrates a device for propelling a looped string in the form factor of an animal according to an example embodiment of the present disclosure.

DETAILED DESCRIPTION

Some embodiments of the present invention will now be described more fully hereinafter with reference to the accompanying drawings, in which some, but not all, embodiments of the invention are shown. Like reference numerals refer to like elements throughout. For purposes of clarity, not every component may be labeled in every figure. Indeed, various embodiments of the invention may be embodied in many different forms and should not be construed as limited to the embodiments set forth herein. Rather, these embodiments are provided so that this disclosure will satisfy applicable legal requirements.

As used herein, the term "or" is used in both the alternative and conjunctive sense, unless otherwise indicated. The term "along," and similarly utilized terms, means near or on, but not necessarily requiring directly on an edge or other referenced location. The terms "approximately," "generally," and "substantially" refer to within manufacturing and/or engineering design tolerances for the corresponding materials and/or elements unless otherwise indicated. Any references to examples, embodiments, components, elements or acts of the device herein referred to in the singular may also embrace embodiments including a plurality, and any references in plural to any embodiment, component, element, or act herein may also embrace embodiments including only a singularity (and/or unitary structure). References in the singular or plural form or unitary or separate components are not intended to limit the presently disclosed device, its components, acts, elements or how they are connected unless expressly stated. Thus, use of any such aforementioned terms, or similarly interchangeable terms, should not be taken to limit the spirit and scope of embodiments of the present invention.

The figures are not drawn to scale and are provided merely to illustrate some example embodiments of the inventions described herein. The figures do not limit the scope of the present disclosure or the appended claims. Several aspects of the example embodiments are described below with reference to example applications for illustration. It should be understood that numerous specific details, relationships, and methods are set forth to provide a full understanding of the example embodiments. One having ordinary skill in the relevant art, however, will readily recognize that the example embodiments can be practiced without one or more of the specific details or with other methods. In other instances, well-known structures and/or operations are not shown in detail to avoid obscuring the example embodiments.

Embodiments of the present disclosure are designed to be used in toys or gadgets that propel a continuous loop of string around a mechanically driven drive wheel at a fast enough rate in order that the string is propelled and climbs into the air in order to maintain a sufficient distance from the ground to perform tricks. The device is configured so that it may be handheld and/or to rest on or in the hand in order to allow for dexterity in order to perform tricks. These toys or gadgets are referred to herein as string shooters, or looped string shooters. Embodiments of the present disclosure employ the use of a string that has high surface area derived from threads, fibers or texture which radiate out from the surface of the string. When viewed closely the string could be described as "fuzzy". While such string shooters can be hand-held, embodiments described herein provide a holder for the string shooter that renders the string shooter wearable and also discloses embodiments where the string shooter includes an integrated holder configured for wearing during operation. Further, embodiments of the string shooter of example embodiments described herein is operable by gestures, without requiring a direct actuation of the string shooter for operation. Embodiments described herein generally relate to string shooting devices, such as the string shooting device of U.S. Pat. No. 11,674,774, application Ser. No. 18/056,567, entitled String Shooting Device, the contents of which are hereby incorporated by reference in their entirety.

Embodiments of the present disclosure include a string with radiating fibers or texture that when accelerated through the air, increases the air friction by expanding the turbulent air boundary layer around the string. Embodiments increase the air friction and when the string runs as a continuous loop, the string creates lift along the length of the string that is propelled outward toward the distal end of the loop. The distal end of the loop, as described herein, is the end of the looped string furthest from the drive wheel of the string shooter. Embodiments of the present disclosure generate a lift force for a rapidly moving looped string by expanding a boundary layer of turbulent air around the string. This expansion of the boundary layer is achieved by threads radiating out from an axis along which the string extends creating friction with the air or "drag" as the string moves through the air.

Embodiments of the present disclosure also have an additional feature of increasing the additive drag that accumulates along a length of the string loop from the point where the outgoing portion of the string leaves a drive wheel of the string shooter, along the length of the string loop to the incoming portion of the string returns to the drive wheel. This increased drag effect enhances the differences between the incoming and outgoing portions of the string loop as it relates to the drive wheel.

This friction accumulation and tension differentiation creates an outgoing portion of the string from the drive wheel that is under low tension. The combination of low tension along with the lift described above creates a distinctive effect such that the string appears to float in the air. The string under these conditions becomes highly susceptible to motions from the user. For instance, movement of the string shooter by a user can introduce waves into the floating string.

FIG. 1 illustrates an example embodiment of a string shooting device 100 in which a looped string 101 having radiating threads 102 is propelled by a drive wheel 103 driven by a motor 104. The outgoing portion of string 109, in relatively low tension, travels to a distal end 107 of the looped string 101 and back to the drive wheel along incoming string 108 portion which is in relatively high tension to the proximal end 106 of the looped string. The body 105 houses the power source, such as a battery, to power the motor 104 that turns the drive wheel 103. The drive wheel 103, driven by the motor 104, provides rotational acceleration to the looped string 101 via frictional engagement between the looped string and the drive wheel. The device features at least one drive wheel, and a second wheel that may be an idling guide wheel, or may be a second drive wheel, driven in an opposite rotational direction as the first drive wheel to grasp and propel the string. Preferably, the looped string interfaces only with the drive wheel 103, a second wheel, and the air around the string. According to some embodiments, the string shooter may include one or more string guides to help maintain the string in the proper orientation relative to the drive wheel as the string is propelled.

While embodiments of the string shooting device 100 may be hand-held and actuated through direct manual actuation, such as by the press of a button, rotation of a dial, or flip of a switch, embodiments described herein are wearable and can be actuated by hand gestures that do not require direct manual actuation, although such wearable devices may also be manually actuated. A wearable device, as described herein, is a device that can be worn by a person where the device does not require grasping of the body of the device during use by a user's fingers. In this regard, the attachment or holding may be described as passive and the wearer does not need to think about actively holding the device with their fingers.

A wearable string shooting device 100 of embodiments provided herein can be worn in a variety of positions by a person, though an example embodiment illustrated herein may be arm-, wrist-, or hand-worn. Embodiments that are wearable on an arm, wrist, or hand provides a user with some degree of articulation of the worn device relative to the person's body. An arm, wrist, or hand can generate a wide variety of motions and has many degrees of freedom that promote motion of a worn device which is desirable as detailed below.

FIG. 2 illustrates an example embodiment of a string shooting device 100 as a wrist worn device secured to a back of a user's wrist 130. As shown, the string shooting device 100 is secured to the wrist 130 by a band 140. The band 140 of the illustrated embodiment can be considered a "wrist band"; however, the band 140 may be adjustable in size and therefore worn at different positions along a user's arm and is not limited to being worn at the wrist. FIG. 3 illustrates an example embodiment of a string shooting device 100 as a wrist-worn device secured to the front of a user's wrist 130. The device is again secured to the user's wrist 130 with an adjustable band 140 that is removably attached to the user.

FIG. 4 illustrates another embodiment of a string shooting device 100 as worn on a back of a hand 150. The string shooting device 100 is secured to the hand via band 160. FIG. 5 illustrates yet another embodiment of a string shooting device 100 as worn on the front of a hand 150 and attached to the hand by a band 160.

The aforementioned embodiments are merely examples of wearable string shooting devices and their respective configurations. Such wearable string shooting devices can be worn in any number of ways and on many locations of a wearer not limited to those illustrated above. The band shown in FIGS. 2-4 can be an elastic band, a band having little elasticity but having an adjustment mechanism (e.g., hook-and-loop fastener, buckle, strap adjusters, etc.), or a combination thereof. The degree of elasticity may be chosen based on the actuation mechanism as detailed further below. Actuation mechanisms that rely on tension applied to a band may benefit from a band having less elasticity, while mechanisms that do not rely on tension applied to a band may be compatible with fully-elastic bands, non-elastic bands, or any degree of elasticity therebetween.

The band described above is an example embodiment of how a string shooting device may be worn by a user. Beyond a single band, embodiments can include multiple bands, a sleeve, or any article that may be worn around a part of the body that accommodates a string shooting device, including for example a band or sleeve including a pocket sized to fit the body of the string shooter. FIG. 6 illustrates an example embodiment of a string shooting device 100 worn by a hand 230 using a palm band 210 and a wrist band 220. The use of two bands as shown in the embodiment of FIG. 6 can provide additional directional stability for the string shooting device, and can provide a more secure attachment that can be useful during movement of the hand and wrist while using the string shooter. Further, the illustrated embodiment can benefit from relative movement between the hand and the wrist as a motion for actuating the string shooter as described further below.

FIG. 7 illustrates an embodiment of a string shooting device 100 worn by a user around the forearm 250 using a sleeve 240. The embodiment of FIG. 7 provides a very stable attachment between the wearer of the sleeve 240 and the string shooting device 100 received within pocket 242. This can be beneficial for active users of the string shooting device, such as when a string shooting device is used in game play or through dance as an artistic display, for example.

While the above-described embodiments detail a variety of attachment configurations for a wearable string shooting device, it is important to be able to activate the string shooting device while it is worn in addition to when it may be carried by a hand. If a string shooting device is carried on one arm, wrist, or hand, the opposing hand could be used to actuate the string shooting device regardless of the worn position. However, it is desirable to be able to actuate the string shooting device without requiring a second hand, and in some embodiments, without requiring the physical touching of the string shooting device. Such embodiments can provide a visually appealing effect of a string being propelled without the use of hands, and possibly from a concealed location creating an illusion of the propelled string emanating from the wearer of the device.

FIG. 8 illustrates an example embodiment of how a palm-worn string shooting device 100 can be actuated, where a user folds their thumb 310 into their palm 320 and presses a switch 111 of the device to actuate the propulsion of the string (not shown). The embodiment of FIG. 8 provides a wearable string shooting device with actuation through manual (digital) touch.

FIG. 9 illustrates a mechanism for actuating the string shooting device 100 that does not require the use of a finger to depress a switch. As shown, a band 330 is attached to the string shooting device 100 by a loop 340 depicted as transparent and shown in broken lines for clarity. Partially disposed within the loop 340 and between the loop and the string shooting device 100 is arm 115. The arm extends out from the loop 340 and away from the string shooting device 100. At a functional end of the arm 115 is a trigger 117. Pressing on the arm 115, particularly closer to the functional end presses the trigger 117 into engagement with the switch 111, thereby activating the string shooting device 100.

FIG. 10 illustrates a portion of the band 330 and loop 340 of the embodiment of FIG. 9, with the string shooting device 100 removed for ease of understanding. As shown, the band 330 includes a single continuous band that forms the loop 340. To do so, a first part 332 of the loop portion of the band 330 includes a split 334 in the middle of a width of the band, while a second part 336 of the loop portion of the band includes a narrowed portion 338 that passes through the split 334. This enables the band 330 to form the loop 340 in a continuous piece of material. According to the illustrated embodiment, when tension is applied to the band 330, the portion of the band worn around a part of the body expands, while the loop 340 contracts. Referring back to FIG. 9, the contraction of the loop 340 presses the arm 115 against a body of the string shooting device 100 and drives the trigger 117 into contact with the switch 111, thereby actuating the string shooting device. Although illustrated as a continuous piece of material, it is expressly understood that the band may be made of more than a single, continuous piece of material and that the material may include other forms such as metal, plastic, and the like.

The band configuration illustrated with respect to FIG. 10 is an example embodiment of how tension can be transferred from the band to apply pressure to at least a portion of the string shooting device. Other embodiments can be employed that provide similar functionality as will be further described below.

According to the illustrated embodiment of FIGS. 9 and 10, a string shooting device 100 worn about a hand can be actuated through making a fist, which would put tension on the band 330 thereby squeezing the loop 340 and actuating the string shooting device 100 as described above. Similarly, a band worn about a forearm will function similarly when a first is made, and a forearm muscle is flexed to expand the band 330 and tension the loop 340.

According to the embodiment of FIG. 9, the arm 115 can be a part of the string shooting device 100 and attached to the body of the device, or part of the loop 340. Functionality is unchanged, while one embodiment may be more preferable than another by virtue of manufacturing, intended end user, and applicability.

FIG. 11 illustrates another example embodiment in which the trigger 117, in the form of a pad, is not attached to an arm as in FIG. 9 but is instead attached inside the loop 340. The tension on the loop 340 may not be sufficient to press the pad of the trigger 117 against the switch 111 to actuate the string shooting device when the device is not worn or is worn and tension is applied to the band 330 tensioning the loop 340. According to such an embodiment, the pad of the trigger 117 itself can be attached to the loop 340 or to the string shooting device switch 111. If attached to the switch, the band 330 may be sold separately as an accessory to accommodate the string shooting device 100 and inserting the string shooting device into the loop 340 and using the device as a worn string shooter with hands-free operation can be simplified.

FIG. 12 illustrates the embodiment of FIG. 11 viewed from a bottom of the string shooting device 100. As shown, the band 330 encircles a body part on which the string shooter is worn. The loop 340 retains the string shooting device to the wearer. When the band 330 is tensioned, the loop 340 tightens and presses the trigger 117 against the switch of the string shooting device 100, thereby activating it.

Embodiments provided herein can be configured for use with a string shooting device 100 in a variety of orientations. FIG. 13 illustrates a different orientation of the string shooting device 100 relative to a wrist of a wearer. As shown, the string shooting device 100 is oriented 90-degrees turned within the loop and band 370 relative to the wearer. Embodiments may enable the string shooting device to be rotated to any position within the loop 340 and retain functionality.

As noted above, the manner in which the loop 340 is tightened in FIG. 10 is an example embodiment as to how pressure can be applied to the body of the string shooting device 100 and applied to the switch 111. Other embodiments can be employed, such as one illustrated in FIG. 14, where the band 430 is attached to loop 440. When tension is applied to the band 430, such as by stretching the band, forces pull along arrows 410 and apply pressure to a device held within the loop 440. Such a configuration can be used to actuate a string shooting device as described above.

FIG. 15 illustrates a string shooting device 500 and a sleeve 510 into which the string shooting device is received as shown on the left side of the figure. The sleeve 510 is illustrated as separated from the string shooting device on the right side of the figure. The sleeve in the exemplary embodiment includes two parts 512 separated by gap 514. The sleeve 510 is formed of a material that has some degree of flexibility but retains its shape. For example, the sleeve 510 may be an injection molded plastic piece. The gap 514 separating the two parts 512 is positioned to allow the two parts to be pressed toward one another, while the material provides resiliency and returns the two parts 512 to their original position (as depicted) when no pressing force is applied. Strain relief 516 at a bottom of the gap 514 enables this flexing of the two parts 512 toward one another and to return to their original positions without substantial wear or work hardening of the material of which the sleeve 510 is made.

In practice, when the string shooting device 500 is received within the sleeve 510, the two parts are disposed on opposite sides of the string shooting device. The sleeve 510 is positioned such that the gap 514 is on opposing sides of the string shooting device 500 that do not include the actuating switch. Thus, when the two parts 512 are flexed toward one another, one of the two parts 512 presses the actuation switch and actuates the string shooting device.

FIG. 16 illustrates the embodiment of FIG. 15 as worn by a user around a hand 505. The string shooting device 500, received within the sleeve 510 (in a position with the gap sides facing to the left and right of the drawing sheet) is attached to the hand 505 with a band 520. The band can be an adjustable strap, an elastic strap, etc. Tension applied to the band 520 squeezes the sleeve 510, causing the two parts of the sleeve to bend, i.e. move toward one another, at least partially closing the gap. This motion causes the sleeve 510 to press the actuation switch and activate the string shooting device. FIG. 17 illustrates an example embodiment of a hand actuating the string shooting device and propelling the string 525 by closing two fingers of the hand 505, which tensions the band 520 and actuates the string shooting device. This is just one example of a hand position that would actuate the string shooting device, as closing of all fingers would similarly actuate the device. Depending on how tight the band is, and how sensitive the actuation switch is, closing or partial closing of even a single finger could actuate the device in some embodiments.

The sleeve of the embodiments of FIGS. 15-17 operates in a similar manner as the loop of the embodiments of FIGS. 9-14 by transmitting a force from the band to the string shooting device by way of the sleeve or loop. Collectively, the sleeve and loop are referred to herein as a holder, such that the holder holds the string shooting device, and a mechanism of the holder applies pressure to the actuation switch of the string shooting device to actuate the device. Thus, the sleeve and loop both function as holders as described herein.

FIG. 18 illustrates an example embodiment of a string shooting device 600 similar to the above-described devices including a body 605 and housing 610. The housing 610 of the illustrated embodiment includes an opening or slot 615 through which a string is loaded into the device 600 to be propelled in a loop as illustrated with respect to FIG. 1. Switch 602 can be used to turn on the wheels to propel the string from the device. While a switch 602 is depicted, embodiments can employ a switch, relay, selector, pressure sensor, or any other type of sensor to activate the device. The opening or slot 615 in the housing 610 of the device 600 of FIG. 18 is arranged vertically and is substantially straight, i.e., in line with the body 605, as depicted. At least one of the looped string or the housing 610 is formed in order for the string to fit through the slot. The slot may be sized in order to aid in retaining the looped string within the housing 610 in a gap between the wheels of the device.

The device 600 of FIG. 18 also includes a receptacle 620 defining a cavity 621 supported on the body 605 of the device. The cavity 621 is positioned below an intake aperture of the housing 610, where a string enters a gap between the wheels within the housing. The receptacle 620 includes opening 625 that provides access to the cavity 621 within the receptacle 620. The cavity 621, described further below, is positioned to receive therein the looped string when the string is retrieved and store the string when it is not being actively propelled by the device.

Also shown in FIG. 18 is a right guide slot 617 around a substantial portion of a bottom of the housing portion, adjacent the receptacle 620 that covers a right wheel. A string being propelled from a string exit 630 from between the wheels within the housing 610 returns to the housing as it is drawn through the wheels. The right guide slot 617 enables the string to largely avoid contact with the housing 610 and instead return to the right wheel (not shown) within the housing. FIG. 19 illustrates a left front view of the device 600, where the portion of the housing 610 covering the left wheel includes a left guide slot 619 similar to that of the right guide slot 617. These guide slots allow the string to be returned to the intake aperture without contacting the housing 610. As shown in FIG. 1, when the device is held by a right hand, the left guide slot 619 provides reduced friction operation as the string returns to the left wheel. However, when the device is held in a left hand, the right guide slot 617 provides reduced friction operation of the string as the string returns to the right wheel. The left guide slot 619 and the right guide slot 617 combine to make the device operate with reduced friction regardless of the hand holding the device.

When loading a looped string into the housing 610, the string is pressed through the slot 615. FIG. 19 illustrates an example embodiment of a device 600 similar to that of FIG. 18, though where the body 605 is unitary with and includes the cavity 621 defined therein without having a separate receptacle. FIG. 19 further illustrates the process by which a string 650 is loaded into the device whether configured as shown in FIG. 18 or as in FIG. 19. To do so, a user performs a motion similar to flossing teeth, whereby the string is pulled taught across the slot 615, and while holding a top portion 652 of the string 650 above the string exit 630, presses a bottom portion 654 of the string toward an intake aperture directly below the string exit. Opening 625 of the device 600 enables this motion to occur providing access to the cavity 621, thereby making loading of the string more accessible for a user.

FIG. 20 illustrates the device 600 of FIGS. 18 and/or 19 actively propelling the string 650 in the direction of arrow 656. The string 650 is a looped string such that it returns to the device taken up at the intake aperture 632 as it continues to be propelled by one or both wheels within the housing 610 and exits through string exit 630. The broken lines are shown to emphasize that the string 650 can be of a wide range of lengths based on user preference or use case.

Embodiments of the devices of FIGS. 18-20 are actuated by switch 602 to propel the string 650 in a loop. String shooting devices generally operate in an on/off manner whereby the motor or motors driving one or more of the wheels are either on or off. However, embodiments described herein employ a retrieval mechanism. When a user is propelling a string as shown in FIG. 20 by pressing the switch 602, the left wheel is turning counterclockwise shown by arrow 614, while the right wheel is turning clockwise shown by arrow 612. This propels or "shoots" the string from the device. However, upon release of the switch 602, the motor(s) reverse direction substantially immediately. The left wheel begins to turn clockwise, while the right wheel begins to turn counterclockwise.

When the wheels reverse direction upon release of the switch 602, the string exit 630 becomes an intake, while the intake aperture 632 becomes an exit. This actively retrieves the string, effectively shooting or propelling the string into the cavity 621 of the receptacle 620. FIG. 21 illustrates this action, with the wheels reversing to retrieve and pull the string 650 in the direction of arrow 658. The string 650 is shown piling up in the cavity of the receptacle 620 visible through opening 625. Because the string is a loop, the string does not tangle when entering the cavity, which is important to enjoyment of the device as when a string is tangled it is not properly propelled from the device. Retrieval of the string to be received within the cavity 621 packs the string into the cavity in a manner that ensures the string is ready to be propelled at any point. FIG. 22 illustrates the string 650 fully retrieved, with the string pulled taught around the housing 610.

The cavity, whether as unitary with the body 605 or as a separate receptacle 620 is generally very smooth without features on which the string can be snagged or grabbed, such as burrs or sharp edges, for example. The smoothness of the receptacle improves the function of the retrieval of the string and the subsequent shooting of the string from the cavity 621. A smooth interior surface of the cavity enables the string, as retrieval begins, to reach a bottom of the cavity such that the first portion of the string into the receptacle is at the bottom of the cavity. This is because the retrieval and subsequent propelling of the string functions best when the string is fed in a "first in last out" or FILO manner, where the first portion of the string retrieved into the cavity 621 during retrieval is the last portion of the string propelled out of the receptacle when the string is again propelled.

The opening 625 is sized to ensure the string does not spill out of the cavity 621 and the opening does not interfere with retrieval of the string. For example, the opening 625 may include a rounded edge or entrance that is flared outward from the receptacle to ensure the string does not get caught on the opening. The cavity 621 of the illustrated embodiment is positioned immediately adjacent the intake aperture 632, which becomes the exit during retrieval of the string. This ensures alignment between the intake aperture and the receptacle which facilitates retrieval into the receptacle. The receptacle is sized to ensure a string can fit within the cavity 621 when fully retrieved. Too large of a cavity 621 renders the device unnecessarily bulky, while too small of a receptacle can lead to jamming of the string into the cavity, which can lead to tangles that can preclude the motors from spinning the wheels requiring manual intervention.

Upon retrieving the string 650 into the cavity 621 of the receptacle 620, the wheels stop turning and the device is off.

This can be performed, for example, until the length of the string 650 is substantially disposed within the cavity 621. The automatic retrieval of the string requires the wheels to spin in the reverse direction until the string is fully retrieval. This can be performed in several ways. A first method involves spinning the wheels in the reverse direction upon release of the switch 602 for a predetermined amount of time. The amount of time can be set to be sufficient to retrieve a largest length of looped string offered with the device. A margin of error may be added to that time, such as a percentage (e.g., 10% longer than should be necessary) or a set amount of time (e.g., 3 seconds longer than should be necessary). If shorter strings are used in such an embodiment, the wheels may spin longer than necessary to retrieve the string. The wheels may in some embodiments continue spinning once the string is fully retrieved until the predetermined time expires, with the wheels slipping against the string. This is referred to as "grip-then-slip" retrieval of the string, as the wheels grip the string and retrieve the string, but upon fully retrieving the string, the wheels then slip on the string until the predetermined amount of time ends. This grip-then-slip functionality requires the gap between the wheels to be appropriately sized for the string and the coefficient of friction between the string and the wheels to be less than an amount of friction that would stall the wheel motors, which could potentially damage the motors.

In some embodiments, the wheels may stall when the string stops moving. This may be achieved through a clutch mechanism built into the wheels and/or the motor(s). In some embodiments, the torque of the motor(s) may not be sufficient to spin the wheels against a stopped string such that the motor stalls temporarily until the time expires.

According to another method, upon release of the switch 602, the wheels may spin in reverse until a torque or force is sensed at the wheels that indicates that the string 650 is stopped. The wheels may spin in the reverse direction until a torque force on the driven wheel(s) exceeds a predetermined amount or threshold that indicates that the string has been fully retrieved into the cavity 621.

Upon pressing the switch 602 again, the string is pulled from the cavity 621 and propelled from the string exit 630 as shown in FIG. 20. FIG. 23 illustrates how this retrieval mechanism can be employed with the wrist worn embodiment described above, where on the left a user has actuated the device 600 and propelled the string 650 from the device. This actuation is shown through curling of two fingers of the hand. The image on the right illustrates the user's hand relaxed with all fingers extended such that the device 600 is not actuated and the string 650 is fully retrieved. The device 600 is illustrated attached to an inside of a user's wrist by a wrist band 603.

While the above-described embodiment retrieves the string using the pair of wheels rotating in a direction opposite that of when they are propelling the string, retrieval can be performed through alternative mechanisms. For example, the cavity 621 of an example embodiment can include an auger, spool, or bobbin around which the string is wound during retrieval. Such an embodiment an optionally employ a motor to turn the auger, spool, or bobbin to pull the string into the receptacle. Further the auger, spool, or bobbin could be implemented without requiring a cavity, where the string is wound and held in place during retrieval. Optionally a stationary hub can be employed with a winding element that guides the string about the hub. In such an embodiment, the winding element may be a driven element to wind the string about the hub during retrieval. Still further, the retrieval mechanism may include a second pair of wheels with a second gap, whereby the second pair of wheels rotate in such a direction as to retrieve the string that is propelled by the first pair of wheels. The second pair of wheels could employ their own motor or motors to perform this retrieval process.

Embodiments of the present disclosure are designed to be used in toys or gadgets that propel a continuous loop of string around a mechanically driven drive wheel at a fast rate. These toys or gadgets are referred to herein as string shooters. Embodiments of the present disclosure can additionally or alternatively employ the use of a looped string that has phosphorescent particles or fibers embedded in or on the string and has high surface area derived from threads, fibers or texture which radiate out from the surface of the looped string. The phosphorescent particles, when charged by light from a light source, emit light.

The string shooting device of some embodiments of the present disclosure include a light source that, as the string passes through the string shooting device, is focused onto at least a portion of the string thereby charging the phosphorescent particles or fibers of the string. The charged phosphorescent particles or fibers of the string emit the charged energy as visible light as the looped string is propelled through the air by the pair of wheels. Embodiments achieve a glow-in-the-dark effect when viewing the string as it emits light in a decaying fashion after it was charged by the light from the light source.

Embodiments of the present disclosure include a looped string having phosphorescent particles or fibers embedded in or on the looped string. In some embodiments, the phosphorescent particles or fibers are embedded in or on the full length of the looped string. In other embodiments, the phosphorescent particle or fibers are embedded in or on the looped string in specific patterns or sections of the string to cause different visual effects when viewing the string, particularly as the string is in motion. The phosphorescent particles or fibers of an example embodiment may be embedded in or on only a portion of the looped string, such as half of the length of the looped string, a striped pattern along the length of the looped string, a zig zag or spiral pattern, an alternating sequence of large sections and small sections of the string along its length, or any other pattern or set of sections that would cause desirable visual effects, particularly when the string is in motion.

The looped string of example embodiments can be dyed with a phosphorescent dye. The string can be dyed along the whole string, a portion of the string, or a pattern along a length of the looped string. In one embodiment, only a small portion of the looped string is dyed with a phosphorescent dye. In such an embodiment, as the string travels around its path in a dark environment, the small portion glows and can be seen traveling about the path of the string. Such an embodiment demonstrates a speed at which the string is traveling as a viewer can plainly see how that small portion of string advances.

FIG. 24 illustrates a device 600 such as the device of FIG. 20 that propels the looped string 650 in the direction of arrow 656, drawing the string into the intake aperture 632 and propelling the string out through the string exit 630. A light source 660 may be disposed within the housing 610 and configured to shine light upon the path of the string as it passes between the intake aperture 632 and the string exit 630. This light source 660 may include a light emitting diode (LED), incandescent, or fluorescent light source. However, in an example embodiment, an LED may be employed for size constraints. The LED may be chosen based upon a wavelength of light emitted that is best suited to charge phosphorescent particles of the looped string 650.

The light source 660 itself may be minimally visible from outside the housing 610 and possibly not visible outside the housing. Minimizing light escape from the housing can improve a perception that the looped string 650 is glowing without it being clear how it is glowing. The light source 660 may include an LED embedded within the housing 610 or within a body of the device, and may employ a light guide to conduct light to the location along the path of the string as it passes through the housing, such as in U.S. patent application Ser. No. 18/441,513, the disclosure of which is incorporated herein by reference.

FIG. 24 also illustrates a second switch 604 which may be used to operate the light source 660. The second switch 604, much like the switch 602 may be a switch of any kind, including a push button, slide switch, toggle switch, motion sensor, light sensor, etc. Further, the switch may require contact to be on (e.g., momentary contact) or may remain on without a user touch, and a momentary contact to turn off. In such an embodiment, the first position can be the movement through the first contact to turn on the switch, and the second position can be the movement through the second contact to turn off the switch. The switch 604 could optionally include a mechanical switch that starts or changes rotation direction of the wheels through a mechanical coupling, for example. The light source 660 may require both the switch 602 and second switch 604 to be in an "on" state or a first position for the light source to function. For example, if the second switch 604 is used for the light source 660, even when the second switch is in the first position or "on", the light source 660 may not illuminate unless the switch 602 is in the first position or "on" and the string is being propelled. This precludes the light source 660 from remaining on when the device is not in use and when the string is not moving through the housing 610. Moving the second switch 604 to the "off" or second position may ensure that the light source 660 does not illuminate when the switch 602 is in the first "on" position or in the second "off" position.

FIG. 25 illustrates an example embodiment of a wrist worn device 700 including a device body 705 that includes therein the receptacle visible through opening 725. The example embodiment is configured in dimension to be worn on the wrist/hand of children and/or adults. The housing 710 covers the pair of wheels with the string exit 730 disposed in the housing on the opposite side of the receptacle integrated into the body 705. The device 700 of FIG. 25 includes a wrist strap 740 and a palm extension 704. The wrist strap 740 is configured to attach proximate a wrist of a wearer, while the palm extension 704 extends into the palm of the wearer. In this manner, the palm extension 704 positions an actuator 702 in the palm of the wearer. The actuator, which may be in the form of a button, pressure sensor, pair of contacts, switch, or other mechanism can be reached by at least the middle and/or ring finger of a wearer to actuate the device 700, in a hand position similar to that shown on the left side of FIG. 23. The actuator 702 can be interacted with to cause operation of the string shooting device. For example, a first interaction may be to press a button or flip a switch, whereas a second interaction may include releasing the button or flipping the switch to another position.

The device 700 may optionally include a forearm strap 745 to stabilize the attachment of the device to a wearer's wrist, and to maintain alignment of the device with the wrist and hand of the wearer. The wrist worn device 700 of FIG. 25 is also illustrated in FIG. 26 as attached to an inside of a user's wrist by the wrist strap 740 and forearm strap 745. The body 705 of the illustrated embodiment is shown with smoothed edges and a tapered shape. This may be conducive to a wrist worn device 700 as the smooth and tapered body would more easily be received within a sleeve of a shirt or concealed within a shirt sleeve to conceal the device. Concealing the device within a shirt sleeve can provide a more impressive appearance when seen by someone other than the wearer and can give the wearer the impression that the string is being shot from their wrist.

FIG. 27 illustrates a device similar to that illustrated in FIGS. 25 and 26. However, the palm extension 704 is hinged at hinge 706, and the palm extension is biased, such as by a string, in a direction shown by arrow 755 about the hinge. This biasing force ensures that when the wrist worn device 700 is worn by a user, the palm extension 704 remains in contact with a user's palm. Further, the biasing force of the palm extension 704 along arrow 755 moves the palm extension away from a path of the string and encourages a wearer to move their hand in the direction of the bias, which also urges the hand away from a path of the string as it is propelled by the wrist worn device 700.

Also illustrated in the embodiment of FIG. 27 is a threading boss 712. When a handheld string shooting device is loaded with the looped string, a user is able to hold the body and a portion of the string with one hand, and thread the looped string through the housing 710 with relative ease. However, in the case of wrist worn string shooting device 700 as shown in FIG. 27, the hand of a wearer on the arm to which the device is attached has limited mobility relative to the device and can thus make threading the looped string into the wrist worn string shooting device difficult. The threading boss 712 aids in the threading of a looped string through the loading slot 715 of the wrist worn device 700 by providing an anchor point that can be used to hold one end of the looped string as the string is pulled across the loading slot and pressed into opening 725 by the finger of a user.

FIG. 28 illustrates a manner of threading the looped string 750 into the loading slot 715 using a single hand 790 and the threading boss 712. As shown, a user can grasp the looped string within the hand 790 opposite the hand of the wrist to which the wrist worn device 700 is attached with a portion of the looped string 750 exposed. The looped string 750 is hooked over the threading boss 712 and pulled tight by the user's hand 790 over the loading slot 715. The user can then use a finger to press the string into opening 725, thereby driving the looped string 750 through the loading slot 715 and successfully threading the looped string into the wrist worn device 700 using only one hand due to the threading boss 712 functionality.

FIG. 29 illustrates a device 800 for propelling a looped string where the body 805 is a unitary body incorporating both the functional elements of the string shooting device and containing the cavity 821 within the unitary body 805. This unitary body is afforded a sleek shape conducive to being worn within a shirt sleeve, such as at a cuff. Attachment points 815 provide slots through which straps can be received, where the straps are configured to attach to a wearer. The straps can be selected based on a size of a wearer and/or the straps can be adjustable to accommodate wearers of various sizes. Also shown is the extension 804, positioned at a downward angle relative to the body 805 and may be positioned in a palm of a wearer when the device 800 is worn on the inside of a wrist. The extension 804 can include an actuator 802 as described above with respect to FIGS. 26 and 27. The extension 804 can be in a fixed position or flexibly biased in the angled position shown. The angle of the extension 804 encourages a wearer's palm to remain clear of the path of the projected string that emanates from the housing 810 that covers the wheels.

FIG. 30 illustrates another example embodiment of a string shooting device 850 having a unitary body 855 with a sleek profile adapted to be wrist-worn and conducive to being worn under a shirt sleeve. The device 850 can attach to a wrist with strap 875, positioning extension 854 in the palm of a wearer. The embodiment of FIG. 30 illustrates an example in which the motor housing is enclosed within the body 855 providing a different overall form factor while retaining the same string shooting capabilities as devices described above. The string may be loaded by a user by threading the string through slot 860 and pushing the string down between the wheels by pressing the string through the opening 865 into the cavity within the body 855. The string is propelled through aperture 870 of the body 855 in a similar manner as described in the aforementioned embodiments. The string can be retrieved into a cavity within the body 855. The embodiment of FIG. 30 conceals the string when it is fully retrieved which provides an added visual effect of a string seemingly appearing from the aperture 870 and disappearing within the aperture. Although shown as a unitary member, the body may, if desired, may be made as a separate member.

FIG. 31 illustrates another example embodiment of a wrist worn string shooting device 900 including a unitary body 905 that houses the cavity, visible partly through opening 925. The housing 910 of the embodiment of FIG. 31 is uniquely configured to provide additional functionality other than at least partially covering the first wheel 902 and the second wheel 904 and providing the loading slot 915. According to the illustrated embodiment, the housing 910 includes a smooth surface that is curved over the first wheel 902 and the second wheel 904. This shape provides both a pleasing visual aesthetic but also provides unique functionality that aids in reducing tangling of the looped string. The top illustration of FIG. 31 illustrates the wrist worn string shooting device 900 actively propelling the looped string with the looped string propelled out along 930 and returned to the gap between the first wheel 902 and the second wheel 904 along 935. While the wrist worn string shooting device is actively propelling the looped string the functionality is similar to the above-described embodiments. However, during retrieval of the looped string the function of the housing 910 becomes apparent.

FIG. 32 illustrates three stages of the retrieval of the looped string. Once the actuation of the wrist worn string shooting device 900 is ceased, the retrieval of the looped string commences. The top illustration of FIG. 32 illustrates s the looped string 950 is nearly fully retrieved substantially into the cavity of the body 905 of the device. As the looped string approaches the housing, the small loop of string remaining outside of the housing gets closer to the housing due to the string being pulled by the first wheel 902 and the second wheel 904 along arrow 945. Rather than the string stopping once looped around the portion of the housing 910 at least partially covering the first wheel 902, due to the curved shape of the housing 910, the looped string begins to slide up the housing as shown in the middle illustration of FIG. 32, where the looped string 950 begins to ride up the housing 910 and over the first wheel 902.

The retrieval of the looped string 950 continues with the wheels pulling the string until the looped string reaches the top of the housing as shown in the bottom illustration of FIG. 32, where the looped string is aligned with the loading gap, overlaying the portion of the looped string that is within the gap between the first wheel 902 and the second wheel 904. This retrieved position of the looped string is advantageous as there is no directional bias to the looped string when it is again propelled out of the string exit 930. With the looped string aligned with the middle of the housing 910, regardless of orientation of the wrist worn string shooting device 900 upon actuating the device again and propelling the looped string, the looped string does not begin with a portion of the string looped around a portion of the housing around either of the first wheel 902 or the second wheel 904. This reduces opportunities for tangles and greatly improves efficiency and effectiveness of the retrieval and re-actuation of the string shooting device.

According to a different embodiment of the device described herein, the device may be embodied by an animal, such as a frog or a lizard as depicted in FIG. 33. The illustrated device 1000 may include a body 1005 where a head of the animal serves as the housing 1010 within which the wheels are disposed. The cavity may be disposed inside the body 1003. Actuation of the device 1000 may be achieved by actuating an actuator 1002, which may be a button, switch, sensor, etc. Optionally, the device 1000 may be actuated by a gesture, such as a hand flexing as described with regard to some embodiments above.

The device 1000 may be wrist worn or otherwise attachable to a person. In response to actuation of the device 1000, such as via actuator 1002, a mouth of the animal may open to some degree and become the string exit 1030, whereby the looped string 1050 emanates from the mouth in a way that appears as the animal's tongue.

The device 1000 depicted in FIG. 33 can be hand-held, wrist worn or otherwise attached or worn by a person, and in some embodiments, may be displayed such as on a surface. According to example embodiments which are provided for display, the device 1000 may be operable by a remote control or use a switch that does not require a user to hold down a switch to maintain the device in the operating state. Such a switch could include a toggle switch, a push-on/push-off switch, or other type of switch to turn the device on and keep it on.

Each of the embodiments described herein can be configured to be maintained in the on state with the driven wheels turning to propel the string from the string exit while the device is held, worn, or displayed without deviating from the hand-held and body-worn embodiments described herein.

The device of some embodiments may be remotely controlled, such as through Bluetooth™, whereby a user may use their cell phone, such as through an app on the cell phone, to operate the device. The remote may alternatively be a dedicated remote that operates on a different near-field communication protocol or on a radio signal, for example. For use with a remote control, the remote control, whether wired, wireless, dedicated remote, or mobile device (e.g., a mobile phone), the remote control can provide the functionality described by the first switch 602 and second switch 604 described above. An example embodiment of a dedicated remote control can include a body-worn control, such as a palm-worn button, a fingertip-worn device, or any such potential remote control that is not part of the body of the device described herein.

The devices of embodiments described above can be used for entertainment through visual effect of the floating string but can also be employed in various gaming scenarios. For example, a game of "tag" whereby a user must touch another user with the string emanating from their device. As the string is lightweight and necessarily highly flexible, the string would not hurt a person through impact. Optionally, the devices described herein can be used for a form of "target" shooting, whereby small lightweight targets are targeted by a user, and may respond to the touch of the looped string. Further, the string of example embodiments can be used to "lasso" objects for retrieval, and embodiments can be used for games involving retrieval of objects, such as objects with hooks about which the looped string can be targeted. Embodiments described herein can be used in a variety of form factors and for a wide variety of entertainment purposes as will be appreciated in view of the foregoing disclosure.

Applicant notes that while the embodiment described above generally refers to both wheels as being driven wheels, either by the same or different motors, embodiments can employ a mechanism by which only one wheel is driven and achieve similar benefits as described above. As such, embodiments described herein are not limited to two driven wheels but can include only a single driven wheel.

The present disclosure generally describes embodiments of a string shooting device that can be used as an entertainment device or toy. However, embodiments can be implemented in other use cases. For example, a device employing the same propelling and retrieving into a receptacle technique can be implemented for charging cables or cable management. Embodiments can be employed in devices that are used to propel strings, ropes, or cables, such as for arborists who rope trees and branches, for climbers who use ropes for repelling and climbing support, for contractors that use plumb lines, or the like. Examples can have utility in any such activity that involves use of an elongated body in the form of rope, string, wire, cable, etc. Thus, while embodiments have been described with regard to a string shooting device for entertainment, embodiments can have much greater utility in other such fields.

Many modifications and other embodiments of the present disclosure set forth herein will come to mind to one skilled in the art to which this disclosure pertains having the benefit of the teachings presented in the foregoing descriptions and the associated drawings. Therefore, it is to be understood that the present disclosure is not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated, in light of the present disclosure, that different combinations of elements and/or functions can be provided by alternative embodiments without departing from the scope of the appended claims. In this regard, for example, different combinations of elements and/or functions than those explicitly described above are also contemplated as can be set forth in some of the appended claims. Although specific terms are employed herein, they are used in a generic and descriptive sense only and not for purposes of limitation.

The invention claimed is:

1. A device for propelling a string comprising:

a body comprising a cavity;

an extension supported by the body and extending therefrom in a first direction away from the body;

at least one driven wheel attached to the body;

at least one strap configured to attach to a wrist of a user and to position the extension within a palm of the user;

at least one button positioned on the extension, wherein the at least one button is positioned on the palm within reach of at least one finger of the user in response to the at least one strap attaching to the wrist of the user and, wherein the at least one button is configured to cause the at least one driven wheel to be driven in a first direction in response to actuation, and in a second direction, opposite the first direction, to move the string toward the cavity; and a looped string, wherein the looped string is propelled away from the body in the first direction in response to the at least one driven wheel being driven in the first direction.

2. The device of claim 1, wherein the at least one button controls the at least one driven wheel via a wire from the at least one button.

3. The device of claim 1, wherein the extension is in a fixed position relative to the body.

4. The device of claim 1, wherein the extension is flexible and biased toward the palm of the user.

5. The device of claim 1, wherein the cavity is positioned on an opposite side of the at least one driven wheel from the extension.

6. The device of claim 5, further comprising a looped string, wherein the looped string is propelled away from the body away from the cavity in response to the at least one driven wheel being driven in the first direction, and wherein the looped string is propelled into the cavity in response to the at least one driven wheel being driven in the second direction.

7. The device of claim 6, wherein depressing the at least one button causes the at least one driven wheel to be driven in the first direction, and release of the at least one button causes the at least one driven wheel to be driven in the second direction.

8. The device of claim 7, wherein release of the at least one button causes the at least one driven wheel to be driven in the second direction for a predetermined amount of time.

9. The device of claim 1, wherein the cavity extends in a first direction and wherein the extension extends in a second direction, opposite the first direction.

10. The device of claim 1, further comprising a housing disposed over the at least one driven wheel, wherein the housing attaches to the body and covers the at least one driven wheel.

11. A device for propelling a string comprising:

a body comprising a cavity and;

an extension supported by the body and extending therefrom in a first direction away from the body;

at least one driven wheel attached to the body, wherein the cavity is positioned on an opposite side of the at least one driven wheel from the extension;

an actuator positioned on the extension, wherein the actuator is configured to cause the at least one driven wheel to be driven in a first direction in response to actuation, and in a second direction, opposite the first direction, to move the string toward the cavity; and a looped string, wherein the looped string is propelled away from the body the first direction in response to the at least one driven wheel being driven in the first direction.

12. The device of claim 11, wherein the actuator controls the at least one driven wheel via a wire from the actuator.

13. The device of claim 11, wherein the extension is in a fixed position relative to the body.

14. The device of claim 11, wherein the looped string is propelled away from the body away from the cavity in response to the at least one driven wheel being driven in the first direction, and wherein the looped string is propelled into the cavity in response to the at least one driven wheel being driven in the second direction.

15. The device of claim 14, wherein depressing the actuator causes the at least one driven wheel to be driven in the first direction, and release of the actuator causes the at least one driven wheel to be driven in the second direction.

16. The device of claim 15, wherein release of the actuator causes the at least one driven wheel to be driven in the second direction for a predetermined amount of time.

17. The device of claim 11, wherein the cavity extends in a first direction and wherein the extension extends in a second direction, opposite the first direction.

18. The device of claim 11, further comprising at least one strap configured to attach to a wrist of a user and configured to position the extension within a palm of the user, wherein in response to the at least one strap attaching to the wrist of the user the actuator is configured to be positioned on the palm within reach of at least one finger of the user.

19. The device of claim 18, wherein the extension is flexible and biased toward the palm of the user in response to the at least one strap attaching to the wrist of the user.

20. A device for propelling a string comprising:

a body comprising a cavity;

an extension connected to the body and extending away from the body in a first direction;

at least one driven wheel attached to the body;

at least one strap configured to attach to a wrist of a user;

at least one button positioned remotely from the body, wherein the at least one button is configured to cause the at least one driven wheel to be driven in a first direction in response to actuation, and in a second direction, opposite the first direction, to move the string toward the cavity; and a looped string, wherein the looped string is propelled away from the body in the first direction in response to the at least one driven wheel being driven in the first direction.

* * * * *